US006706422B2

(12) United States Patent
Inoue et al.

(10) Patent No.: US 6,706,422 B2
(45) Date of Patent: Mar. 16, 2004

(54) ELECTROLESS NI—B PLATING LIQUID, ELECTRONIC DEVICE AND METHOD FOR MANUFACTURING THE SAME

(75) Inventors: Hiroaki Inoue, Tokyo (JP); Kenji Nakamura, Kanagawa-ken (JP); Moriji Matsumoto, Kanagawa-ken (JP); Hirokazu Ezawa, Tokyo (JP); Masahiro Miyata, Kanagawa-ken (JP); Manabu Tsujimura, Kanagawa-ken (JP)

(73) Assignees: Ebara Corporation, Tokyo (JP); Kabushiki Kaisha Toshiba, Tokyo (JP)

( * ) Notice: Subject to any disclaimer, the term of this patent is extended or adjusted under 35 U.S.C. 154(b) by 29 days.

(21) Appl. No.: 09/994,834

(22) Filed: Nov. 28, 2001

(65) Prior Publication Data

US 2002/0100391 A1 Aug. 1, 2002

(30) Foreign Application Priority Data

Nov. 28, 2000 (JP) ..... 2000-360807
Feb. 9, 2001 (JP) ..... 2001-034428

(51) Int. Cl.[7] ..... B32B 15/04; B32B 15/20; B05D 7/14; H01B 5/14

(52) U.S. Cl. ..... 428/680; 428/674; 428/673; 428/627; 428/336; 427/437; 427/438; 174/126.4

(58) Field of Search ..... 427/436, 437, 427/438; 205/151; 174/126.4; 439/887; 428/673, 671, 674, 675, 680, 627, 469, 699, 700, 704, 336

(56) References Cited

U.S. PATENT DOCUMENTS

| | | | | | |
|---|---|---|---|---|---|
| 3,781,596 | A | * | 12/1973 | Galli et al. | 317/101 F |
| 4,503,131 | A | * | 3/1985 | Baudrand | 428/672 |
| 5,269,838 | A | * | 12/1993 | Inoue et al. | 106/1.22 |
| 5,431,804 | A | * | 7/1995 | Caballero | 204/129 |
| 5,705,230 | A | | 1/1998 | Matanabe et al. | 427/438 |
| 5,861,076 | A | * | 1/1999 | Adlam et al. | 156/281 |
| 6,066,406 | A | * | 5/2000 | McComas | 428/680 |
| 6,362,089 | B1 | * | 3/2002 | Molla et al. | 438/612 |
| 2003/0019426 | A1 | * | 1/2003 | Inoue et al. | 118/429 |

OTHER PUBLICATIONS

Lopatin, S., et al. "Characterization of Electroless Cu, Co, Ni and Their Alloys for ULSI Mettallization", Materials Research Society Conference Proceedings ULSI XIII (1998), pp. 437–443, (no month).

* cited by examiner

*Primary Examiner*—Michael La Villa
(74) *Attorney, Agent, or Firm*—Wenderoth, Lind & Ponack, L.L.P.

(57) ABSTRACT

There is provided an electroless Ni—B plating liquid for forming, a Ni—B alloy film on at least part of the interconnects of an electronic device having an embedded interconnect structure, the electroless Ni—B plating liquid comprising nickel ions, a complexing agent for nickel ions, a reducing agent for nickel ions, and ammonums ($NH_4^+$). The electroless Ni—B plating liquid can lower the boron content of the resulting plated film without increasing the plating rate and form a Ni—B alloy film having an FCC crystalline structure.

7 Claims, 27 Drawing Sheets

X-ray diffractometry
Ni-B/Ag/Cu/TiN
ag depo
incidence angle for thin film 5°
CuKα λ =1.54A 1000
500
Ag(111)
Ag(200)
Ni(111)
4.2at%B
Ag(220)
Cu(200)
Ni(200)

1000
500
Ag(111)
Cu(111)
Ag(200)
13.5at%B
Cu(200)

1000
500
0
Ag(111)
Cu(111)
Ag(200)
20at%B
Cu(200)
30.00
40.00
50.00
60.00
70.00

X-ray diffractometry
Ni-B/Ag/Cu/TiN
anncaled for 50min
in Ar at 573K
incidence angle for thin film 5°
CuKα λ=1.54A Ag(111)
Ni(111)
4.2at%B
Ni(200)
Ag(220)

13.5at%B
Ni3B
(031)
(211)
(002)
(112)
(221)
Ni(200)

20at%B
Ni3B
1000
500
0
30.00
40.00
50.00
60.00
70.00

ELECTROLESS NI— B PLATING LIQUID, ELECTRONIC DEVICE AND METHOD FOR MANUFACTURING THE SAME

BACKGROUND OF THE INVENTION

1. Field of the Invention

This invention relates to an electroless Ni—B plating liquid, an electronic device and a method for manufacturing the same. More particularly, this invention relates to an electroless Ni—B plating liquid useful for forming a protective film for protecting the surface of the interconnects of an electronic device which has such an embedded interconnect structure that an electric conductor, such as silver or copper, is embedded in fine recesses for interconnects formed in the surface of a substrate such as a semiconductor substrate, and to an electronic device having the interconnects-protecting film formed by using the plating liquid, and a method for manufacturing the same.

2. Description of the Related Art

As a process for forming interconnects in an electronic device, the so-called "damascene process" which comprises filling trenches for interconnects and contact holes with a metal (electric conductor), is coming into practical use. According to this process, aluminum or, more recently a metal such as silver or copper, is filled into trenches for interconnects and contact holes previously formed in the interlevel dielectric of a semiconductor substrate. Thereafter, an extra metal is removed by chemical mechanical polishing (CMP) so as to flatten the surface of the substrate.

In the case of interconnects formed by such a process, the embedded interconnects have an exposed surface after the flattening processing. When an additional embedded interconnect structure is formed on such an exposed surface of the interconnects of a semiconductor substrate, the following problems may be encountered. For example, during the formation of a new $SiO_2$ in the next interlevel dielectric forming process, the exposed surface of the pre-formed interconnects is likely to be oxidized. Further, upon etching of the $SiO_2$ film for formation of via holes, the pre-formed interconnects exposed on the bottoms of the via holes can be contaminated with an etchant, a peeled resist, etc.

In order to avoid such problems, it has conventionally been performed to form a protective film of SiN or the like not only on the interconnect region of a semiconductor substrate where the interconnects are exposed, but on the whole surface of the substrate, thereby preventing the contamination of the exposed interconnects with an etchant, etc.

However, the provision of a protective film of SiN or the like on the whole surface of a semiconductor substrate, in an electronic device having an embedded interconnect structure, increases the dielectric constant of the interlevel dielectric, thus inducing delayed interconnection even when a low-resistance material such as silver or copper is employed as an interconnect material, whereby the performance of the electronic device may be impaired.

In views of this, it may be considered to selectively cover the surface of the exposed interconnects with a Ni—B alloy film having a good adhesion to an interconnect material such as silver or copper and having a low resistivity (ρ). A plated Ni—B film, obtained by electroless Ni—B plating, is either a crystalline or an amorphous plated film depending on the boron content of the film. In this regard, a crystalline plated film is obtained when the boron content of the film is less than 10 at % (atomic %), and an amorphous plated film is obtained when the boron content of the film is 10 at % or more, generally.

When a plated Ni—B film is used for the purpose of protecting the interconnects of an electronic device having an embedded interconnect structure, the plated film is required to be thermally stable. From this point of view, it is necessary to use a crystalline plated film having a boron content of less than 10 at %. This is because a crystalline plated Ni—B film maintains its crystallinity after a heat treatment, whereas an amorphous Ni—B plated film forms a Ni—B compound upon the heat treatment and thus becomes an unstable film.

However, when an intended crystalline Ni—B film, for the purpose of protecting the interconnects of an electronic device having an embedded interconnect structure, is formed by electroless plating by using a plating liquid that is formulated to provide a plated film having a lowered boron content, the plating rate is likely to become too high to make a proper control of the process.

In this regard, in electroless plating, the reaction time is equal to the solid-liquid contact time between the plating liquid and an object to be plated. Further, a plated Ni—B film to be used for protecting the interconnects of an electronic device must be as thin as several tens to several hundreds nm. Accordingly, an enhanced plating rate makes the process control more difficult.

SUMMARY OF THE INVENTION

The present invention has been made in view of the above situation in the related art. It is therefore an object of the present invention to provide an electroless Ni—B plating liquid which can lower the boron content of the resulting plated film without increasing the plating rate and form a Ni—B alloy film having an FCC (face centered cubic) crystalline structure, and also to provide an electronic device in which the interconnects are protected with the plated film formed by electroless plating carried out by using the plating liquid, and a method for manufacturing the same.

In order to achieve the above object, the present invention provides an electroless Ni—B plating liquid for forming a Ni—B alloy film on at least part of interconnects of an electronic device having an embedded interconnect structure, the electroless Ni—B plating liquid comprising nickel ions, a complexing agent for the nickel ions, a reducing agent for the nickel ions, and ammoniums ($NH_4^+$).

The inclusion of ammonums ($NH_4^+$) in the plating liquid can lower the boron content of the plated film to provide a Ni—B alloy film having an FCC crystalline structure, and can also lower the plating rate by ammoniums ($NH_4^+$) so as to thereby facilitate the process control. It is considered, in this regard, that an ammonia ion, due to its generally high chelating force, may form a complex with a nickel ion to thereby lower the plating rate.

The reducing agent may be, for example, an alkylamine borane or a hydrogen boride compound. Specific examples of the alkylamine borane include dimethylamine borane, diethylamine borane and trimethylamine borane. $NaBH_4$ may be mentioned as a specific example of the hydrogen boride compound.

The ammonums may be prepared from e.g. ammonia water.

The pH of the electroless Ni—B plating liquid may be adjusted within the range from 8 to 12. By thus increasing the pH of the plating liquid to 8–12, it becomes possible to lower the boron content of the plated film and form a Ni—B alloy film having an FCC crystalline structure. The pH of the plating liquid is preferably 9–12, more preferably 10–12.

The temperature of the electroless Ni—B plating liquid may be adjusted within the range from 50° C. to 90° C. To raise the liquid temperature to 50° C. or higher promotes the plating reaction, whereas to control the liquid temperature to 90° C. or lower prevents an increase in the boron content of the plated film. The temperature of the plating liquid is preferably adjusted to 55–75° C.

The present invention also provides an electronic device having an embedded interconnect structure of silver, silver alloy, copper or copper alloy, wherein a surface of an interconnect is selectively covered with a protective layer of a Ni—B alloy film.

By thus selectively covering the surface of the interconnects and protecting the interconnects with the protective film of a Ni—B alloy film that has a high adhesion to silver or copper and has a low resistivity (ρ), an increase in the dielectric constant of the interlevel dielectric of an electronic device having an embedded interconnect structure can be suppressed. Further, the use as an interconnect material of a low-resistance material, such as a silver or copper, can attain speedup and densification of the electronic device.

The present invention further provides a method for manufacturing an electronic device, comprising; electroless plating an electronic device having an embedded interconnect structure with an electroless Ni—B plating liquid to form a protective layer of a Ni—B alloy film selectively on a surface of an interconnect of the electronic device; wherein the electroless Ni—B plating liquid comprises nickel ions, a complex agent for nickel ions, a reducing agent for nickel ions, and ammonums ($NH_4^+$).

Plating with an electroless Ni—B plating liquid containing an alkylamine borane or a hydrogen boride compound as a reducing agent, e.g. an electroless Ni—B plating liquid containing as a reducing agent DMAB (dimethylamine borane) that causes an anodic oxidation reaction with silver, is known to be effected selectively onto silver or copper. Thus, by immersing the substrate of an electronic device having an exposed surface of interconnects in the plating liquid, plating is effected selectively onto the exposed surface of the interconnects.

The above and other objects, features, and advantages of the present invention will be apparent from the following description when taken in conjunction with the accompanying drawings which illustrates preferred embodiments of the present invention by way of example.

DETAILED DESCRIPTION OF THE PREFERRED EMBODIMENTS

Preferred embodiments of the present invention will now be described with reference to the drawings.

Figure 1A:
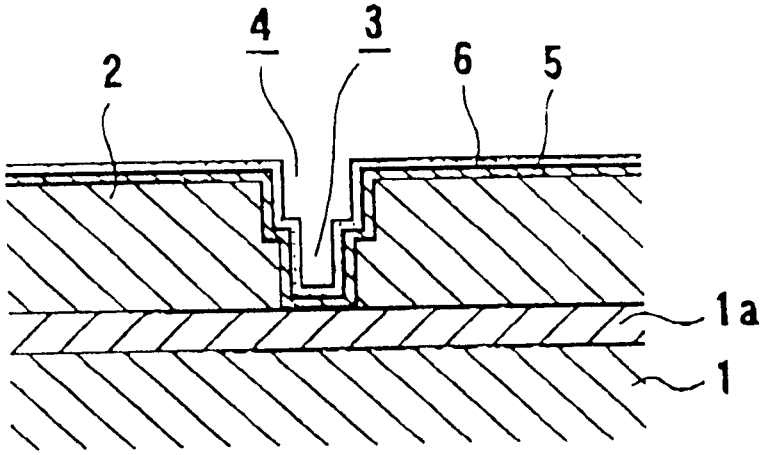
FIGS. 1A through 1C are diagrams illustrating, in a sequence of process steps, an example of forming silver interconnects in an electronic device in accordance with the present invention.
Figure 1B:
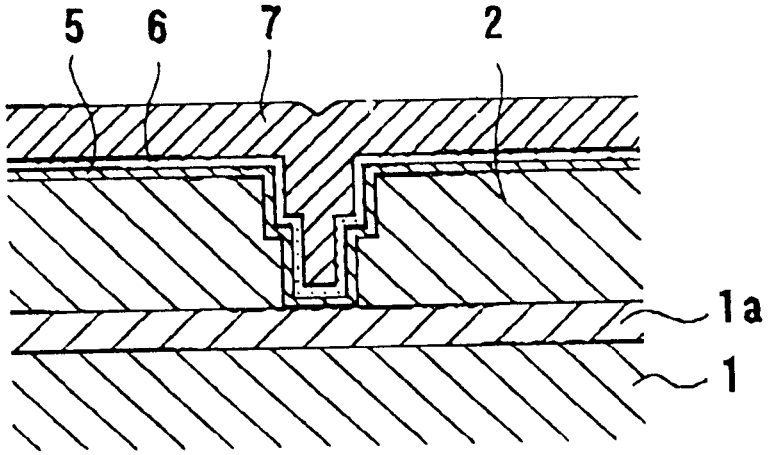
Figure 1C:
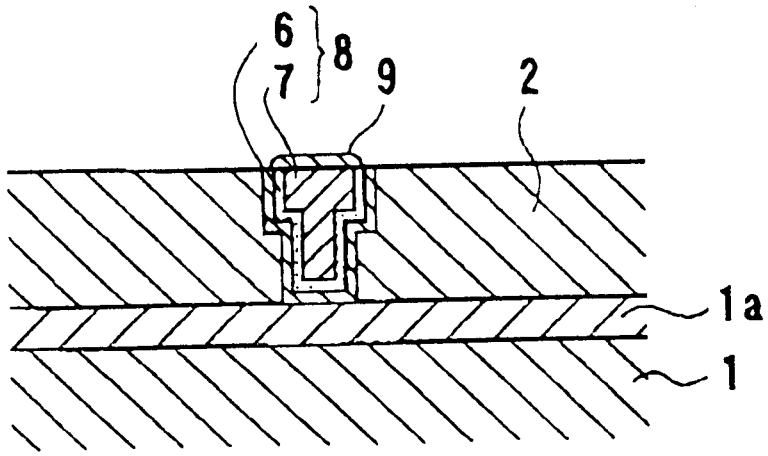

FIGS. 1A through 1C illustrate, in a sequence of process steps, an example of forming silver interconnects in an electronic device according to the present invention. As shown in FIG. 1A, an insulating film 2 of $SiO_2$ is deposited on a conductive layer 1*a* in which electronic devices are formed, which is formed on an electronic device substrate 1. A contact hole 3 and a trench 4 for interconnects are formed in the insulating film 2 by the lithography/etching technique. Thereafter, a barrier layer 5 of TaN or the like is formed on the entire surface, and a copper seed layer 6 as an electric supply layer for electroplating is formed on the barrier layer 5.

Then, as shown in FIG. 1B, silver plating is performed onto the surface of the electronic device substrate 1 to fill the contact hole 3 and the trench 4 with silver and, at the same time, deposit a silver layer 7 on the insulating film 2. Thereafter, the silver layer 7 on the insulating film 2 is removed by chemical mechanical polishing (CMP) so as to make the surface of the silver layer 7 filled in the contact hole 3 and the trench 4 for interconnects and the surface of the insulating film 2 lie substantially on the same plane. Interconnects 8 composed of the copper seed layer 6 and the silver layer 7, as shown in FIG. 1C, are thus formed in the insulating layer 2.

Next, electroless Ni—B plating is performed onto the surface of the substrate 1 to selectively form a protective film 9 composed of a Ni—B alloy film of an FCC crystalline structure, having a boron content of 0.01 at %–10 at %, on the exposed surface of the interconnects 8, thereby protecting the interconnects 8. The thickness of the protective film 9 is generally 0.1–500 nm, preferably 1–200 nm, more preferably 10–100 nm.

The protective film 9 is formed selectively on the exposed surface of the interconnects 8 by using an electroless Ni—B plating liquid containing nickel ions, a complexing agent for nickel ions, an alkylamine borane or a hydrogen boride compound as a reducing agent for nickel ions, and ammonums ($NH_4^+$), a pH of the plating liquid being adjusted to e.g. 8–12, and dipping the surface of the substrate 1 in the plating liquid.

The protection of the interconnects 8 by the provision of the protective film 9 can prevent, in forming thereon an additional embedded interconnect structure, the oxidation of the surface of the interconnects during formation of a new $SiO_2$ in the next interlevel dielectric forming process, and the contamination of the interconnects with an etchant or a peeled resist upon etching of the $SiO_2$ film.

Further, by selectively covering the surface of the interconnects 8 and protecting the interconnects 8 with the protective film 9 of a Ni—B alloy film that has a high adhesion to silver as an interconnect material and has a low resistivity (ρ) an increase in the dielectric constant of the interlevel dielectric of an electronic device having an embedded interconnect structure can be suppressed. Further, the use of as an interconnect material of silver, which is a low-resistance material, can attain speedup and densification of the electronic device.

Though this example shows the use of silver as an interconnect material, a silver alloy, copper or a copper alloy may also be used.

Figure 8:
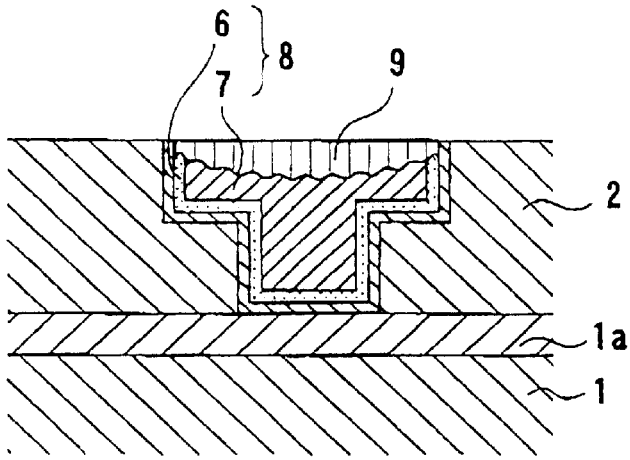
FIG. 8 is a cross-sectional diagram illustrating another example of forming a protective film in an electronic device in accordance with the present invention.

In performing a CMP treatment onto the surface of the substrate 1 in which the silver layer is filled, there is a case where in a relatively wide trench for interconnects, the surface of the interconnects 8 composed of the copper seed layer 6 and the silver layer 7 is dished, as shown in FIG. 8. When electroless Ni—B plating is performed onto such a dished surface of the interconnects 8, the dished space is filled with the protective film 9 composed of the Ni—B alloy film, whereby the interconnects 8 can be prevented from being exposed.

The present plating liquid for use in the electroless Ni—B plating will now be described in detail below. The present plating liquid is characterized in that a pH of the plating liquid is adjusted to 8–12 by using ammonia water, thereby controlling the boron content of the protective film 9 (plated film) to less than 10 at % to provide the protective film 9 with an FCC crystalline structure, and lowering the plating rate.

First, a first plating liquid (the present plating liquid) was prepared by using, as shown in Table 1 below, 0.02 M of $NiSO_4.6H_2O$ as a supply source of divalent nickel ions, 0.02 M of DL-malic acid and 0.03 M of glycine as complexing agents for nickel ions, and 0.02 M of DMAB (dimethylamine borane) as a reducing agent for nickel ions, and by adjusting the pH of the plating liquid to 5–12 by using ammonia water. Further, a second plating liquid was prepared in the same manner as in the first plating liquid, except that the pH of the plating liquid is adjusted to 5–12 by using, instead of ammonia water, TMAH (tetramethylammonium hydroxide) which is widely used as a pH adjusting agent.

TABLE 1

| | First plating liquid (the present plating liquid) | Second plating liquid |
|---|---|---|
| $NiSO_4.6H_2O$ | 0.02 M | 0.02 M |
| DMAB | 0.02 M | 0.02 M |
| DL-malic acid | 0.02 M | 0.02 M |
| Glycine | 0.03 M | 0.03 M |
| pH | pH = 5–12 with ammonia water | pH = 5–12 with TMAH |
| Temperature | 60° C. | 60° C. |

Figure 2:
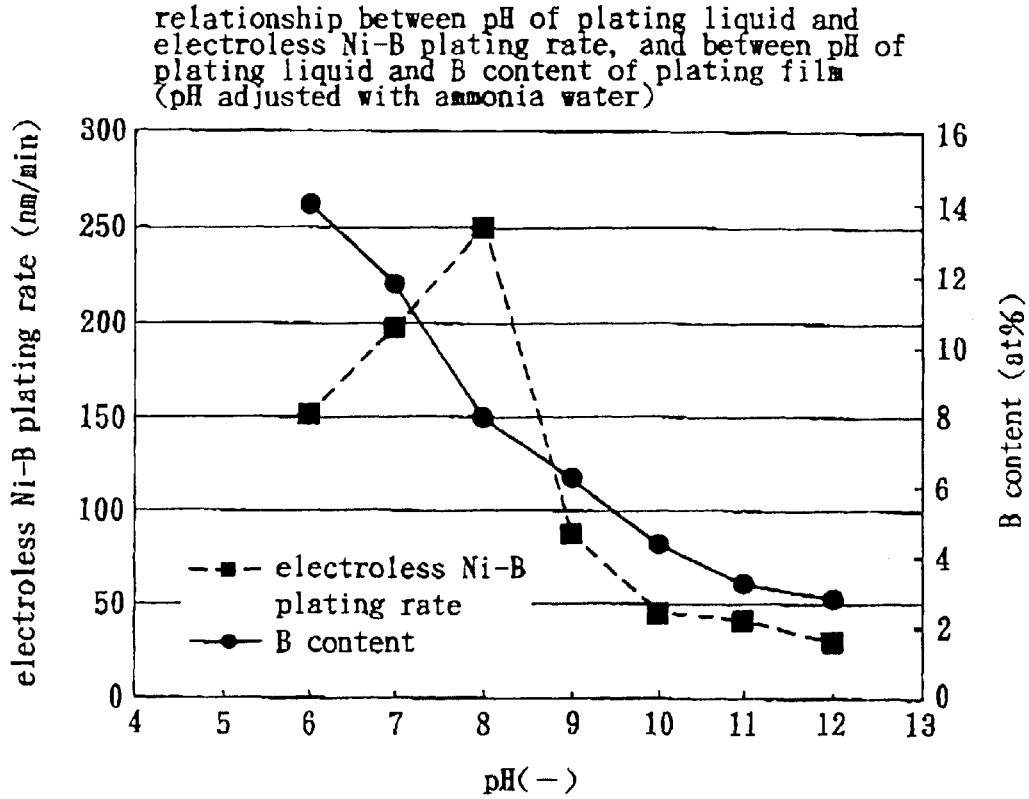
FIG. 2 is a graph showing the relationship between pH of plating liquid and electroless Ni—B plating rate, and between pH of plating liquid and B content of plated film when the pH of a plating liquid is adjusted with ammonia water.

Using the first plating liquid (the present plating liquid) and the second plating liquid, electroless Ni—B plating was performed onto a semiconductor wafer on which a barrier layer (TaN, 20 nm) and a copper film (copper, 100 nm) had been formed by sputtering. By varying the pHs of the respective plating liquids within the pH range of 5–12, the relationship between pH of plating liquid and electroless Ni—B plating rate, and between pH of plating liquid and B(boron) content of plated film was determined, the results of which are shown in FIGS. 2 and 3.

As can be seen from FIG. 2, with respect to the electroless Ni—B plating liquid (first plating liquid) in which the pH is adjusted with ammonia water, the plating rate drastically decreases when the pH exceeds 8, and lowers down to below 100 nm/min in a pH range of 9–12. Further, a Ni—B alloy film having a boron content of less than 10 at % can be obtained when the pH of the plating liquid increases to 8 or more.

Figure 3:
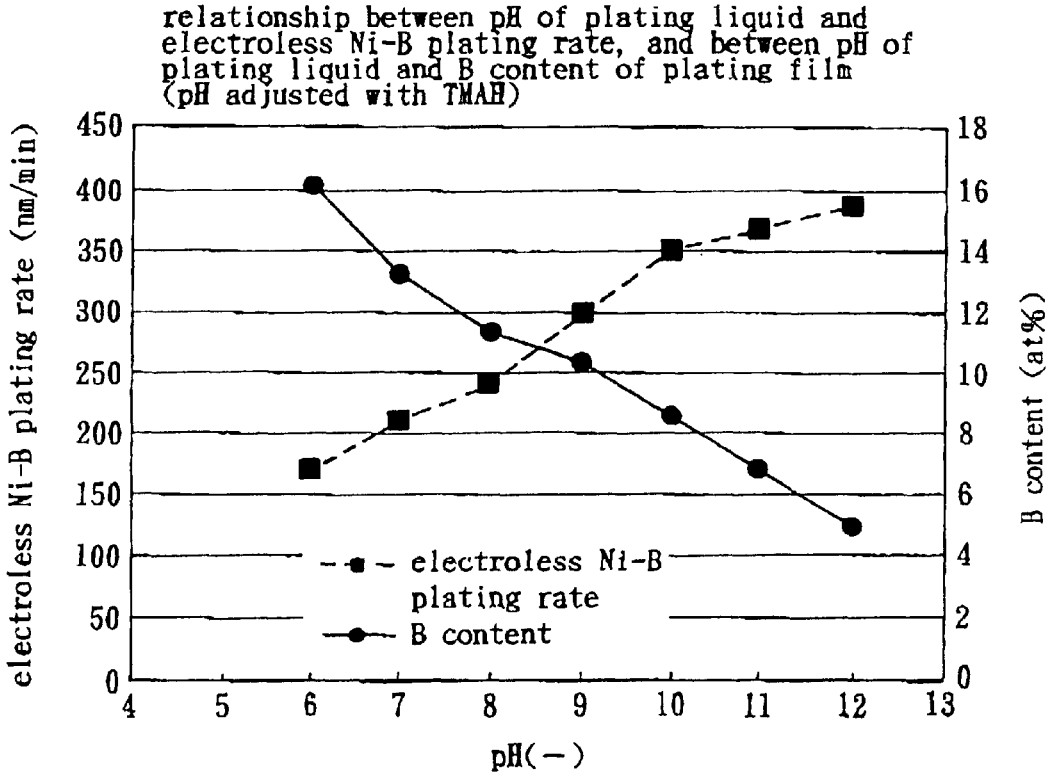
FIG. 3 is a graph showing the relationship between pH of plating liquid and electroless Ni—B plating rate and, between pH of plating liquid and B content of plated film when the pH of a plating liquid is adjusted with TMAH (tetra methylammonium hydroxide)

In contrast, it is apparent from FIG. 3 that in the case of the electroless Ni—B plating liquid (second plating liquid) in which the pH is adjusted with TMAH, though a Ni—B alloy film having a boron content of less than 10 at % may be obtained at a pH exceeding 9, the plating rate increases with an increase in pH and reaches to a considerably high level at a pH exceeding 9.

The above results show that it is preferred to use, as a plating liquid for forming a protective film of Ni—B alloy film in an electronic device having an embedded interconnect structure, an electroless Ni—B plating liquid whose pH is adjusted to 8–12, preferably 9–12, more preferably 10–12, by using ammonia water.

Next, a third plating liquid (the present plating liquid) was prepared by using, as shown in Table 2 below, 0.02 M of $NiSO_4.6H_2O$ as a supply source of divalent nickel ions, 0.02 M of DL-malic acid and 0.03 M of glycine as completing agents for nickel ions, and 0.02 M of DMAB (dimethylamine borane) as a reducing agent for nickel ions, and by adjusting a pH of the plating liquid to 10 with ammonia water and adjusting the temperature of the plating liquid to 60° C.

TABLE 2

| | Third plating liquid (the present plating liquid) |
|---|---|
| $NiSO_4.6H_2O$ | 0.02 M |
| DMAB | 0.02 M |
| DL-malic acid | 0.02 M |
| Glycine | 0.03 M |
| pH | pH = 10 with ammonia water |
| Temperature | 60° C. |

Using the third plating liquid (the present plating liquid), electroless plating was performed onto an electronic device substrate (semiconductor wafer) on which a barrier layer (TaN, 20 nm) and a copper layer (copper, 600 nm) had been formed by sputtering. The Ni—B alloy film thus formed on the substrate had a thickness of 40 nm and a boron content of 4.2 at %. The Ni—B alloy film was examined on its oxidation resistance in terms of the sheet resistance before and after an oxidizing treatment. The results are shown in Table 3.

TABLE 3

| | Sheet resistance (mΩ/sq) |
|---|---|
| After plating | 30.5 |
| After atmospheric heat treatment | 28.7 |
| After $O_2$ plasma ashing | 30.1 |

Atmospheric heat treatment: in air, hot plate, 200° C., 30 min
$O_2$ plasma ashing: 1 Torr, 800 W, 250° C., 30 min.

As apparent from the results of Table 3, there is no substantial change in the sheet resistance after either of the oxidizing treatments, indicating good oxidation resistance of the Ni—B alloy film. This shows that the third plating liquid (the present plating liquid) is suited for use as an electroless Ni—B plating liquid for forming an interconnect-protecting film of Ni—B alloy film in an electronic device having an embedded interconnect structure.

Next, using the third plating liquid (the present plating liquid) having the composition shown in Table 2, electroless plating was performed onto a substrate in which, after forming by sputtering a barrier layer (TiN, 50 nm) and a seed layer (copper, 100 nm) on a semiconductor wafer, a plated Ag film of 500 nm-thickness had been formed by using an electrolytic Ag plating liquid [$KAg(CN)_2$: 0.03 M, KCN: 0.23 M, pH=11, liquid temp. 25° C.] and using a pulse system [pulse current density: 10 mA/cm$^2$, voltage application time: 1 msec & pause time; 10 msec]. The Ni—B alloy film was analyzed by X-ray diffractometry. The Ni—B alloy film thus formed on the substrate had a thickness of 40 nm and a boron content of 4.2 at %. For comparison, two Ni—B alloy films having a boron content of 13.5 at % and of 20 at %, obtained by using commercial electroless Ni—B plating liquids, were also analyzed by X-ray diffractometry. To the respective samples, heat treatment (annealing) was conducted by introducing the substrate (sample) after the electroless plating into a quartz furnace, exhausting the air in the furnace to $1\times10^{-5}$ Torr, introducing a high-purity Ar gas into the furnace, and then heating the substrate at 400° C. for one hour. The X-ray diffraction analysis was conducted on each sample before and after the annealing.

Figures 4A, 4B, 4C:
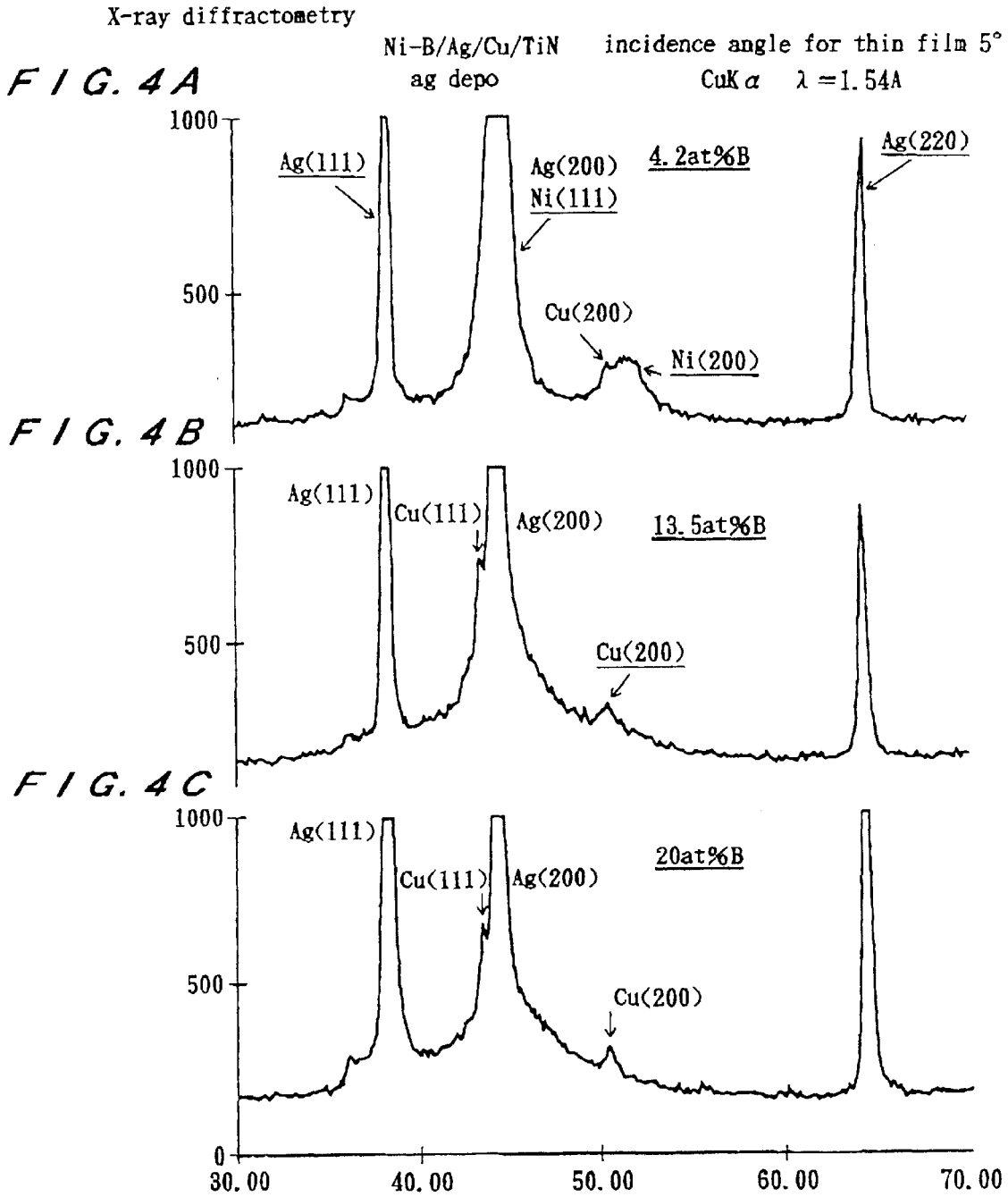
FIG. 4A shows a X-ray diffraction pattern of a Ni—B alloy film having a boron content of 4.2 at %, before annealing, obtained by the use of the present plating liquid.
FIG. 4B shows a X-ray diffraction pattern of a Ni—B alloy film having a boron content of 13.5 at %, before annealing, obtained by the use of a commercial plating liquid.
FIG. 4C shows a X-ray diffraction pattern of a Ni—B alloy film having a boron content of 20 at %, before annealing, obtained by the use of a commercial plating liquid.
Figures 5A, 5B, 5C:
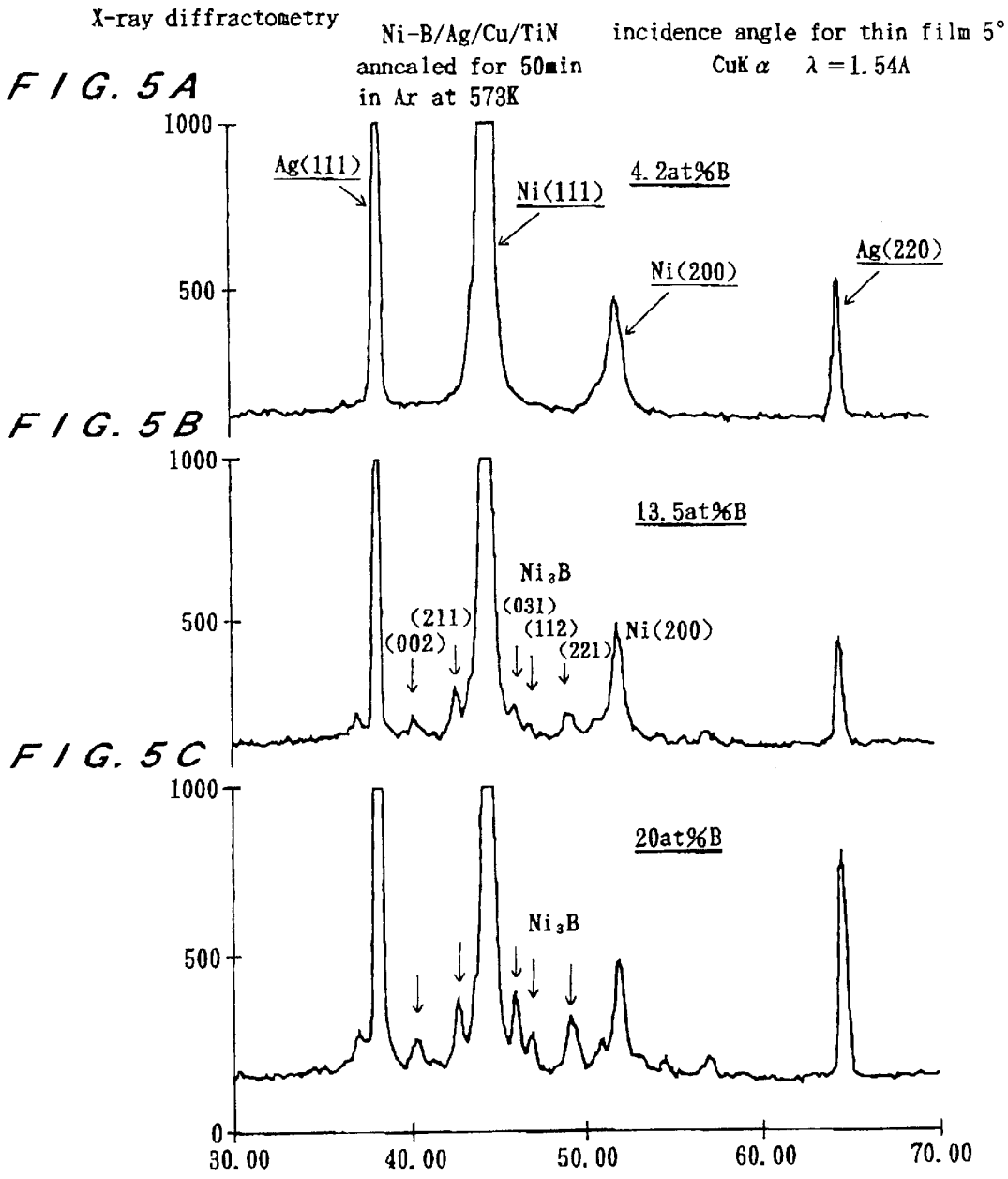
FIG. 5A shows a X-ray diffraction pattern of a Ni—B alloy film having a boron content of 4.2 at %, after annealing, obtained by the use of the present plating liquid.
FIG. 5B shows a X-ray diffraction pattern of a Ni—B alloy film having a boron content of 13.5 at %, after annealing, obtained by the use of a commercial plating liquid.
FIG. 5C shows a X-ray diffraction pattern of a Ni—B alloy film having a boron content of 20 at %, after annealing, obtained by the use of a commercial plating liquid.

FIGS. 4A and 5A show the X-ray diffraction patterns of the Ni—B alloy film having a boron content of 4.2 at %, before and after the annealing, obtained by using the third plating liquid (the present plating liquid); FIGS. 4B and 5B show the X-ray diffraction patterns of the Ni—B alloy film having a boron content of 13.5 at %, before and after the annealing, obtained by using the commercial plating liquid; and FIGS. 4C and 5C show the X-ray diffraction patterns of the Ni—B alloy film having a boron content of 20 at %, before and after the annealing, obtained by using the commercial plating liquid.

It is apparent from these Figures that the Ni—B alloy film having a boron content of 4.2 at %, obtained by using the third plating liquid (the present plating liquid), has an FCC crystalline structure, both before and after the annealing, whereas the Ni—B alloy films having a boron content of 13.5 at % and of 20 at %, obtained by using the commercial plating liquids, are amorphous before the annealing, and become Ni+$Ni_3B$ (intermetallic compound) after the annealing.

The X-ray diffraction data thus shows that the Ni—B alloy film obtained by using the third plating liquid (the present plating liquid) is thermally stable and can maintain the crystalline structure after undergoing a heat treatment. This indicates suitability of the present plating liquid for use as an electroless Ni—B plating liquid for forming an interconnect-protecting film of Ni—B alloy film in an electronic device having an embedded interconnect structure.

Further, using the third plating liquid (the present plating liquid) having the composition shown in Table 2, electroless plating was performed onto a substrate in which, after forming by sputtering a barrier layer (TiN, 50 nm) and a seed layer (copper, 100 nm) on a semiconductor wafer, a plated Ag film of 500 nm-thickness had been formed by using an electrolytic Ag plating liquid [$KAg(CN)_2$: 0.03 M, KCN: 0.23 M, ph=11, liquid temp. 25° C.] and using a pulse system [pulse current density: 10 mA/cm$^2$, voltage application time: 1 msec & pause time: 10 msec]. The Ni—B alloy film thus formed on the substrate had a thickness of 70 nm and a boron content of 4.8 at %. The Ni—B alloy film was examined on its barrier properties. For comparison, the barrier properties of a Ni—B alloy film having a thickness of 90 nm and a boron content of 14.5 at %, obtained by using a commercial electroless Ni—B plating liquid, was also examined. To the respective samples, heat treatment (annealing) was conducted by introducing the substrate (sample) after the electroless plating into a quartz furnace, exhausting the air in the furnace to $1\times10^{-5}$ Torr, introducing a high-purity Ar gas into the furnace, and then heating the substrate at 400° C. for one hour. AES (Auger electronic spectroscopy) analysis was conducted on each sample before and after the annealing.

Figure 6A:
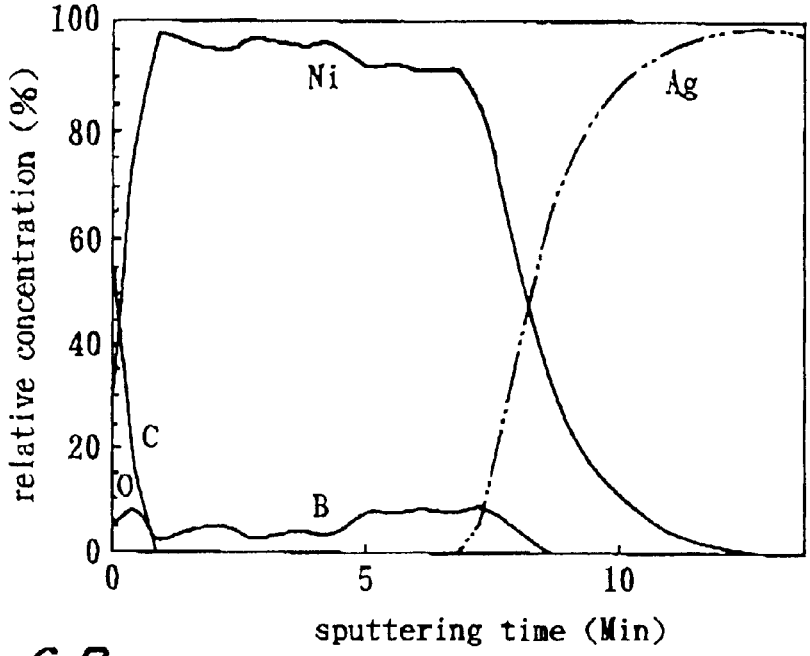
FIG. 6A is a chart showing the results of AES (auger electron spectroscopy) analysis in the depth direction of a Ni—B alloy film having a boron content of 4.8 at %, before annealing, obtained by the use of the present plating liquid.
Figure 6B:
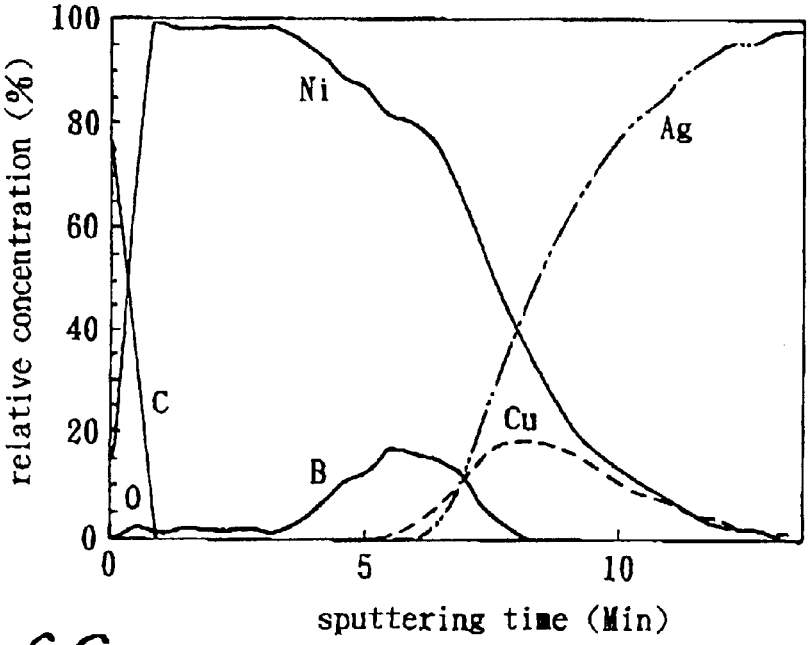
FIG. 6B is a chart showing the results of AES analysis in the depth direction of the Ni—B alloy film of FIG. 6A, but after annealing.
Figure 6C:
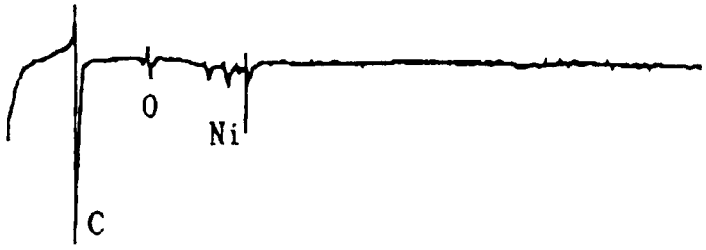
FIG. 6C is a chart showing the results of AES analysis of the surface of the annealed Ni—B alloy film of FIG. 6B.
Figure 7A:
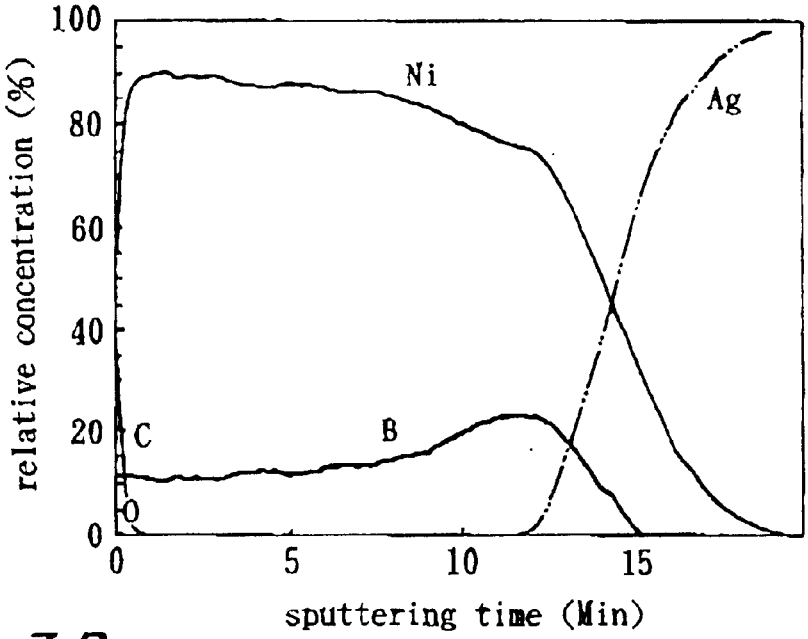
FIG. 7A is a chart showing the results of AES analysis in the depth direction a Ni—B alloy film having a boron content of 14.5 at %, before annealing, obtained by the use of a commercial plating liquid.
Figure 7B:
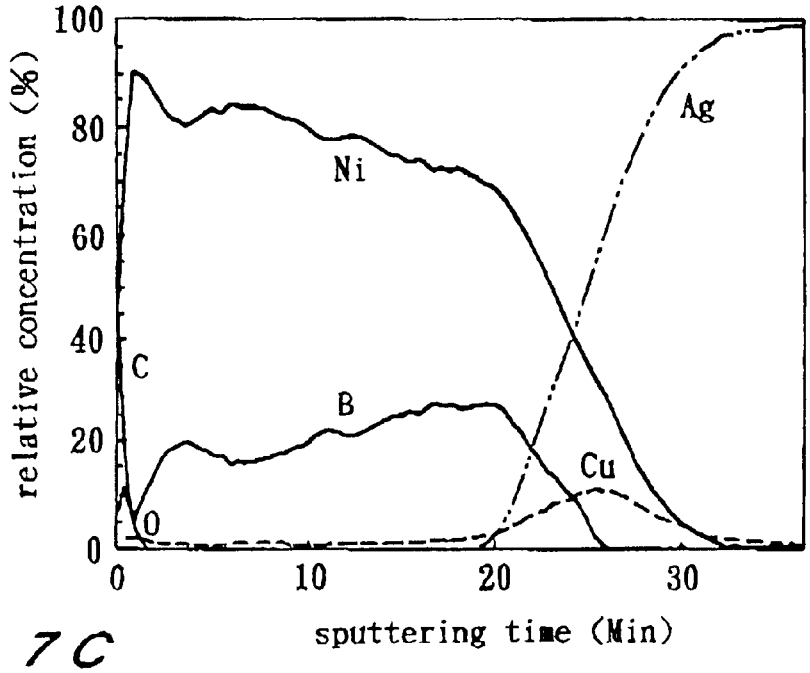
FIG. 7B is a chart showing the results of AES analysis is the depth direction of the Ni—B alloy film of FIG. 7A, but after annealing.
Figure 7C:
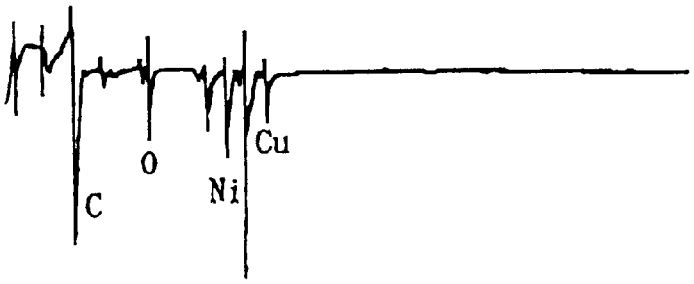
FIG. 7C is a chart showing the results of AES analysis of the surface of the annealed Ni—B alloy film of FIG. 7B.

FIGS. 6A and 6B show the results of AES analysis in the depth direction of the Ni—B alloy film having a boron content of 4.8 at %, before and after the annealing, obtained by using the third plating liquid (the present plating liquid); FIG. 6C shows the results of AES analysis of the surface of the annealed Ni—B alloy film of FIG. 6B. FIGS. 7A and 7B show the results of AES analysis in the depth direction of the Ni—B alloy film having a boron content of 14.5 at %, before and after the annealing, obtained by the use of the commercial plating liquid; and FIG. 7C shows the results of AES analysis of the surface of the annealed Ni—B alloy film of FIG. 7B.

As apparent from these Figures, in the case of the Ni—B alloy cover film having a boron content of 14.5 at %, obtained by using the commercial plating liquid, copper migrates or diffuses through the alloy film onto its surface, whereas no such copper diffusion is seen in the Ni—B alloy cover film having a boron content of 4.8 at % obtained by using the third plating film (the present plating film), indicating that the present Ni—B alloy film functions as an excellent barrier to copper diffusion.

Further, a fourth plating liquid (the present plating liquid) was prepared by using, as shown in Table 4 below, 0.1 M of $NiSO_4.6H_2O$ as a supply source of divalent nickel ions, 0.1 M of DL-malic acid and 0.15 M of glycine as completing agents for nickel ions, and 0.1 M of DMAB (dimethylamine borane) as a reducing agent for nickel ions, and by adjusting the pH of the plating liquid to 5–10 with ammonia water and adjusting the temperature of the plating liquid to 50–90° C.

TABLE 4

| | Fourth plating liquid (the present plating liquid) |
|---|---|
| $NiSO_4.6H_2O$ | 0.1 M |
| DMBA | 0.1 M |
| DL-malic acid | 0.1 M |
| Glycine | 0.15 M |

TABLE 4-continued

| | Fourth plating liquid (the present plating liquid) |
|---|---|
| pH | 5–10 |
| Temperature | 50° C.–90° C. |

Using the fourth plating liquid (the present plating liquid), electroless Ni—B plating was performed onto a sample (25 mm×50 mm) in which a laminated film of Ti (20 mm)/TiN (70 nm)/Cu (200 nm) had been formed in this order by ordinary magnetron sputtering on a silicon substrate, and then a plated Ag film of 500 nm-thickness had been formed by using an electrolytic Ag plating liquid [$KAg(CN)_2$: 0.03 M, KCN: 0.23 M, pH=11, liquid temp. 25° C.] and using a pulse system [pulse current density: 10 mA/cm$^2$, voltage application time: 1 msec & pause time: 10 msec]. Next, the sample after the Ni—B plating treatment was heat-treated (annealed) by introducing the sample into a quartz furnace, exhausting the air in the furnace to $1\times10^{-5}$ Torr, introducing a high-purity Ar gas into the furnace, and then heating the sample at 400° C. for one hour.

Figure 9:
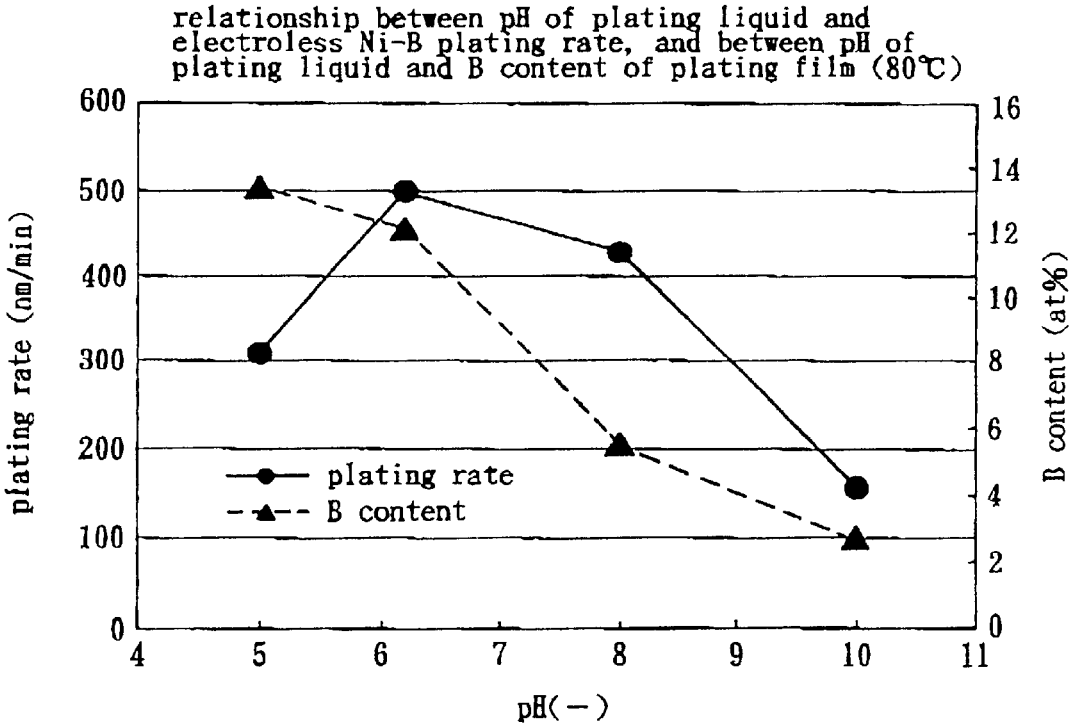
FIG. 9 is a graph showing the relationship between pH of plating liquid and electroless Ni—B plating rate, and between pH of plating liquid and B content of plated film at a constant plating liquid temperature (80° C.)
Figure 10:
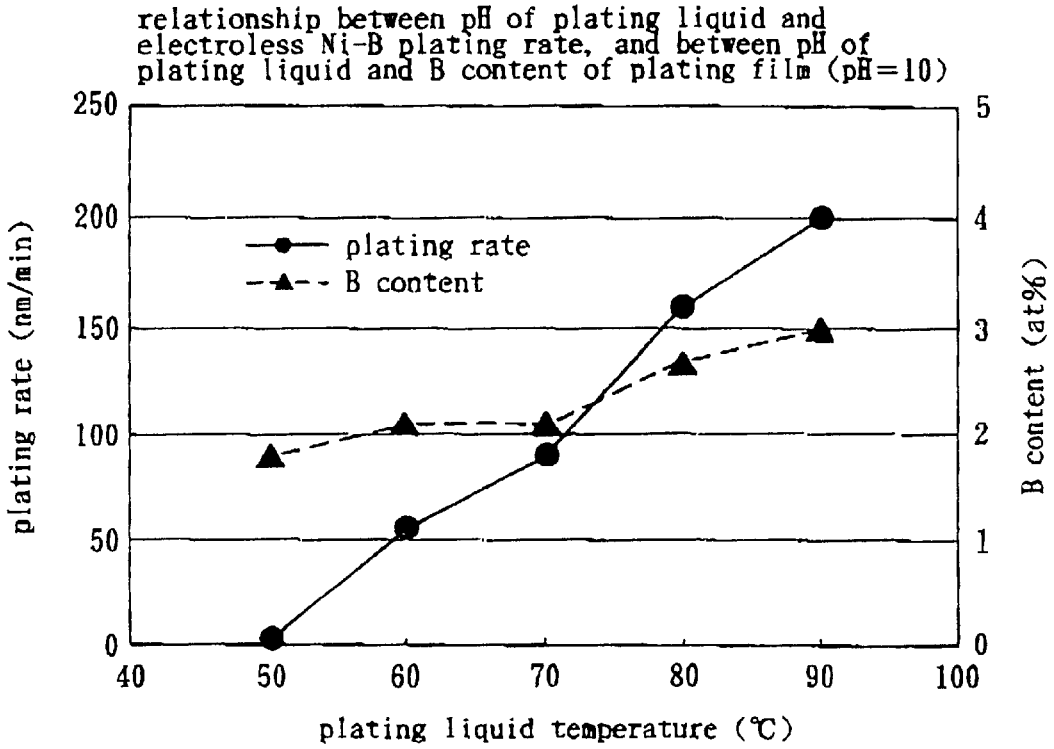
FIG. 10 is a graph showing the relationship between temperature of plating liquid and electroless Ni—B plating rate and between temperature of plating liquid and B content of plated film at a constant plating liquid pH (pH=10)

Table 5, given below, and FIG. 9 show the relationship between pH of plating liquid and plating rate, and between pH of plating liquid and B (boron) content of plated film when the temperature of the plating liquid was made constant at 80° C. while the pH was varied within the range of 5–10. Table 6, given below, and FIG. 10 show the relationship between temperature of plating liquid and plating rate, and between temperature of plating liquid and B (boron) content of plated film when the pH of the plating liquid was made constant at 10 while the temperature was varied within the range of 50–90° C. The measurement of the boron content of a plated film was conducted by dissolving and peeling the plated film with the use of 7N nitric acid, and subjecting the solution to ICP (inductively coupled plasma) emission spectrophotometer.

TABLE 5

| pH (–) | Plating rate (nm/min) | B content (at %) |
|---|---|---|
| 5 | 310 | 13.5 |
| 6.2 | 500 | 12.2 |
| 8 | 430 | 5.5 |
| 10 | 160 | 2.7 |

Note:
plating time: 1 min
plating liquid temp.: 80° C.

TABLE 6

| Temp. (° C.) | Plating rate (nm/min) | B content (at %) |
|---|---|---|
| 50 | 4 | 1.8 |
| 60 | 56 | 2.1 |
| 70 | 90 | 2.1 |
| 80 | 160 | 2.7 |
| 90 | 200 | 3 |

Note:
plating time: 1 min
plating liquid pH: 10

It has been reported that generally in electroless Ni—B plating, the plating rate tends to increase and the boron content of the plated film tends to decrease with an increase in the pH of the plating liquid. However, as shown in Table 5 and FIG. 9, when the pH is increased by using ammonia water, the boron content of the plated film shows a tendency to decrease and, when the pH exceeds 6–8, the plating rate also shows a tendency to decrease. When the pH is made constant at 10, as shown in Table 6 and FIG. 10, the plating rate shows a tendency to increase with an increase in the temperature of the plating liquid. The boron content of the plated film also shows a slight tendency to increase, but at a low level of less than 3 at % even at an elevated plating liquid temperature. FIG. 10 also shows that almost no reaction takes place at 50° C., whereas the plating rate reaches 200 nm/min at 90° C. Thus, the temperature of the plating liquid may be adjusted within the range of 50–90° C., preferably 55–75° C.

Further, in order to determine the Cu barrier effect of the Ni—B alloy film (having a boron content of 3.2%), the above sample after the heat treatment (annealing) was analyzed in the depth direction and on the surface by AES (auger electronic spectroscopy) For comparison, the same analysis was conducted on a Ni—B alloy film having a boron content of 13.5 at % obtained by using a commercial plating liquid. The results of the analysis are shown in Table 7.

TABLE 7

| | Ni—B film thickness | B content | Cu barrier effect |
|---|---|---|---|
| The present plating liquid | 150 nm | 3.2 at % | Observed |
| Commercial plating liquid | 300 nm | 13.5 at % | Not observed |

As well be appreciated from the results of Table 7, the Ni—B alloy film having a boron content of 3.2 at % has a Cu diffusion-preventing effect, whereas the Ni—B alloy film having a boron content 13.5 at % has no Cu diffusion-preventing effect.

Further, in order to analyze the structure of the Ni—B alloy film (having a boron content of 3.2 at %), X-ray diffraction analysis was conducted on the above sample, before and after the heat treatment (annealing). For comparison, the same analysis was conducted on the above comparative Ni—B alloy film having a boron content of 13.5 at %. The results are shown in Table 8.

TABLE 8

| | Ni—B film thickness | B content | Before heat treatment | After heat treatment |
|---|---|---|---|---|
| The present plating liquid | 150 nm | 3.2 at % | Ni (crystalline) | Ni (crystalline) |
| Commercial plating liquid | 300 nm | 13.5 at % | Amorphous | Ni + $Ni_3B$ |

As shown in Table 8, the Ni—B alloy film having a boron content of 3.2 at % has a crystalline phase both before and after the heat treatment (annealing), whereas the Ni—B alloy film having a boron content of 13.5 at % is amorphous before the heat treatment, and becomes Ni+$Ni_3B$ (intermetallic compound) after the heat treatment. This indicates that a Ni—B alloy film of a smaller boron content can better maintain the crystalline phase and is more thermally stable.

It is considered in this connection that the Ni—B having a boron content of 3.2 at % maintains its crystalline phase upon undergoing the heat environment, and boron segregated at a crystal grain boundary may prevent diffusion of copper through the grain boundary. In contrast, the Ni—B alloy film having a boron content of 13.5 at % makes a structural change upon the heat treatment (thermally unstable) to form the intermetallic compound which is fragile, whereby diffusion of copper cannot be prevented.

Figure 11A:
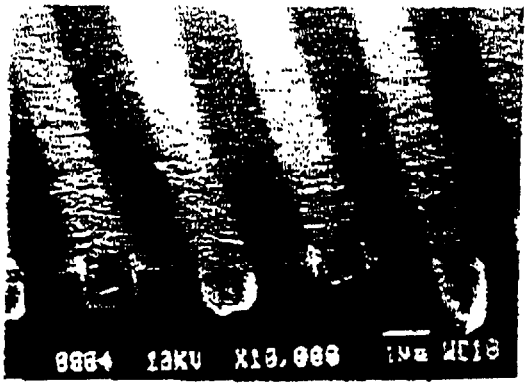
FIGS. 11A and 11B are SEM photographs of silver damascene interconnects formed in a silver substrate.
Figure 11B:
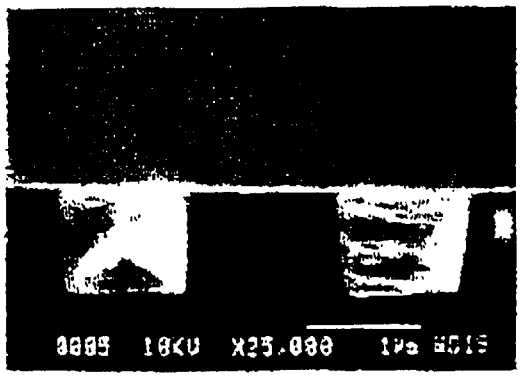
Figure 12A:
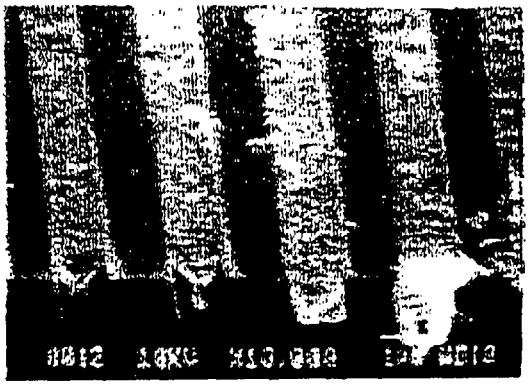
FIGS. 12A and 12B are SEM photographs of a Ni—B alloy protective film formed on the interconnects of FIGS. 11A and 11B.
Figure 12B:
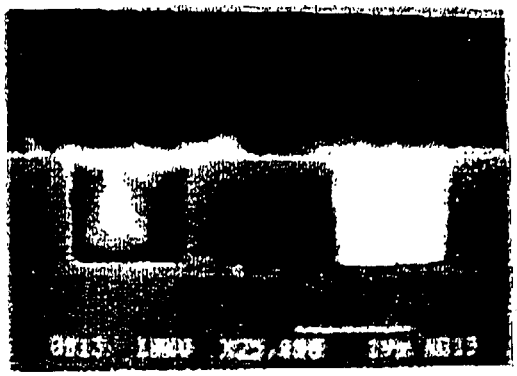

Next, a trial formation of a Ni—B alloy protective film on silver damascene interconnects was performed. FIGS. 11A and 11B are SEM photographs of the silver damascene interconnects (width: 1 μm, spacing: 1 μm, depth of trench: 1 μm) formed in a silicon substrate; and FIGS. 12A and 12B are SEM photographs of the Ni—B alloy protective film formed on the silver damascene interconnects. As shown in these Figures, the Ni—B alloy film was formed selectively on the exposed surface of the silver damascene interconnects.

The above described experimental results clearly show that the Ni—B alloy film having a boron content of 3.2 at %, obtained by using the electroless Ni—B plating liquid which contains ammonums, has a crystalline phase that is thermally stable, and can be suitably utilized as a protective film for multilayer silver interconnects having, for example, a laminated structure of Ti/TiN/Cu/Ag/Ni—B.

Though the above described examples show the use of the present Ni—B alloy film as a protective film, it may also be used as a barrier film since it has a copper diffusion-preventing effect.

As described hereinabove, the electroless Ni—B plating liquid of the present invention, which contains ammonums, can lower the boron content of the plated film without increasing the plating rate and form a Ni—B alloy film having an FCC crystalline structure. By using the present plating liquid, which can facilitate the process control, a protective film of Ni—B alloy film can be formed selectively on the interconnects of an electronic device having an embedded interconnect structure. The present invention can thus contribute to speedup and densification in electronic devices.

Figure 13:
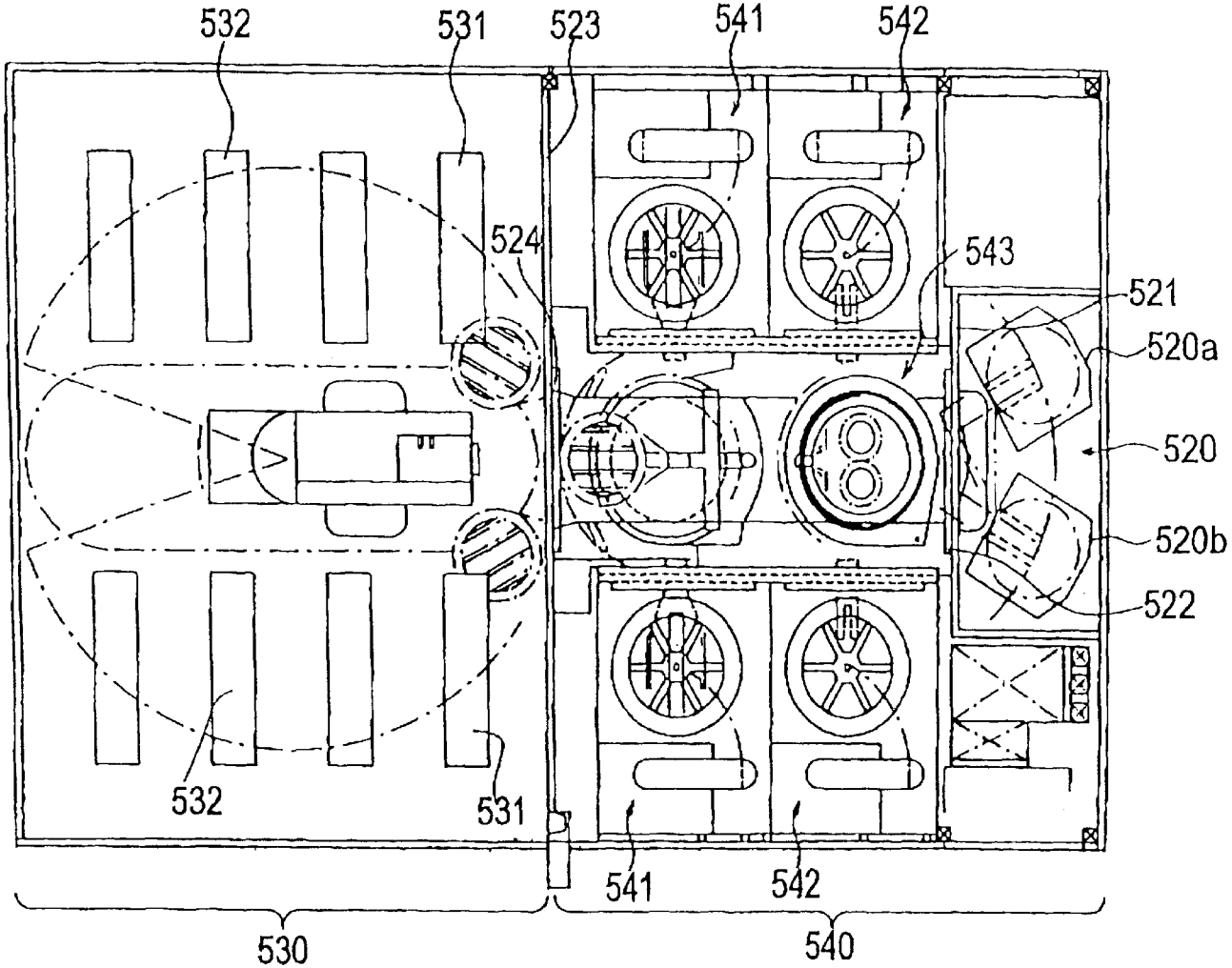
FIG. 13 is a plan view of an example of a substrate plating apparatus.

FIG. 13 is a plan view of an example of a substrate plating apparatus. The substrate plating apparatus shown in FIG. 13 comprises a loading and unloading area 520 for housing wafer cassettes which accommodate semiconductor wafers, a processing area 530 for processing semiconductor wafers, and a cleaning and drying area 540 for cleaning and drying plated semiconductor wafers. The cleaning and drying area 540 is positioned between the loading and unloading area 520, and the processing area 530. A partition 521 is disposed between the loading and unloading area 520, and the cleaning and drying area 540. And a partition 523 is disposed between the cleaning and drying area 540, and the processing area 530.

The partition 521 has a passage (not shown) defined therein for transferring semiconductor wafers therethrough between the loading and unloading area 520, and the cleaning and drying area 540, and supports a shutter 522 for opening and closing the passage. The partition 523 has a passage (not shown) defined therein for transferring semiconductor wafers therethrough between the cleaning and drying area 540, and the processing area 530, and supports a shutter 524 for opening and closing the passage. The cleaning and drying area 540 and the processing area 530 can independently be supplied with and discharge air.

The substrate plating apparatus shown in FIG. 13 is placed in a clean room, which accommodates semiconductor fabrication facilities. The pressures in the loading and unloading area 520, the processing area 530, and the cleaning and drying area 540 are selected as follows:

The pressure in the loading and unloading area 520>the pressure in the cleaning and drying area 540>the pressure in the processing area 530.

The pressure in the loading and unloading area 520 is lower than the pressure in the clean room. Therefore, air does not flow from the processing area 530 into the cleaning and drying area 540, and air does not flow from the cleaning and drying area 540 into the loading and unloading area 520. Furthermore, air does not flow from the loading and unloading area 520 into the clean room.

The loading and unloading area 520 houses a loading unit 520*a* and an unloading unit 520*b*, each accomodating a wafer cassette for storing semiconductor wafers. The cleaning and drying area 540 houses two water cleaning units 541 for cleaning plated semiconductor wafers with water, and two drying units 542 for drying plated semiconductor wafers. Each of the water cleaning units 541 may comprise a pencil-shaped cleaner with a sponge layer mounted on a front end thereof or a roller with a sponge layer mounted on an outer circumferential surface thereof. Each of the drying units 542 may comprise a drier for spinning a semiconductor wafer at a high speed to dehydrate and dry. The cleaning and drying area 540 also has a transfer unit (transfer robot) 543 for transferring semiconductor wafers.

The processing area 530 houses a plurality of pretreatment chambers 531 for pretreating semiconductor wafers prior to being plated, and a plurality of plating chambers 532 for plating semiconductor wafers with copper. The processing area 530 also has a transfer unit (transfer robot) 543 for transferring semiconductor wafers.

Figure 14:
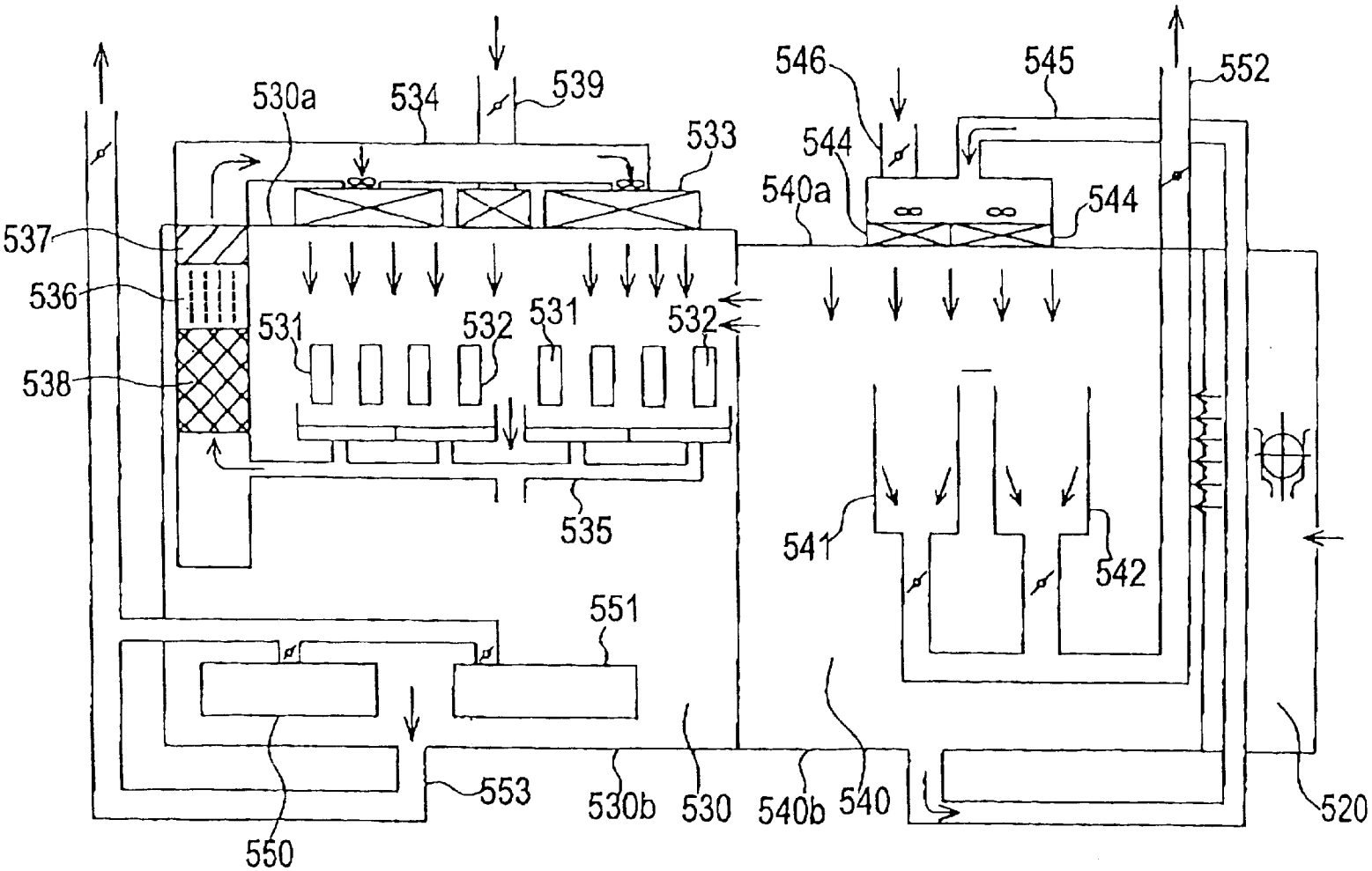
FIG. 14 is a schematic view showing airflow in the substrate plating apparatus shown in FIG. 13.

FIG. 14 shows in side elevation air flows in the substrate plating apparatus. As shown in FIG. 14, fresh air is introduced from the exterior through a duct 546 and forced through high-performance filters 544 by fans from a ceiling 540*a* into the cleaning and drying area 540 as downward clean air flows around the water cleaning units 541 and the drying units 542. Most of the supplied clean air is returned from a floor 540*b* through a circulation duct 545 to the ceiling 540*a*, from which the clean air is forced again through the filters 544 by the fans into the cleaning and drying area 540. Part of the clean air is discharged from the wafer cleaning units 541 and the drying units 542 through a duct 552 out of the cleaning and drying area 540.

In the processing area 530 which accommodates the pretreatment chambers 531 and the plating chambers 532, particles are not allowed to be applied to the surfaces of semiconductor wafers even though the processing area 530 is a wet zone. To prevent particles from being applied to semiconductor wafers, downward clean air flows around the pretreatment chambers 531 and the plating chambers 532. Fresh air is introduced from the exterior through a duct 539 and forced through high-performance filters 533 by fans from a ceiling 530*a* into the processing area 530.

If the entire amount of clean air as downward clean air flows introduced into the processing area 530 were always supplied from the exterior, then a large amount of air would be required to be introduced into and discharged from the processing area 530 at all times. According to this embodiment, air is discharged from the processing area 530 through a duct 553 at a rate sufficient enough to keep the pressure in the processing area 530 lower than the pressure in the cleaning and drying area 540, and most of the downward clean air introduced into the processing area 530 is circulated through circulation ducts 534, 535. The circulation duct 534 extends from the cleaning and drying area 540 and is connected to the filters 533 over the ceiling 530*a*. The circulation duct 535 is disposed in the cleaning and drying area 540 and connected to the pipe 534 in the cleaning and drying area 540.

The circulating air that has passed through the processing area 530 contains a chemical mist and gases from solution bathes. The chemical mist and gases are removed from the circulating air by a scrubber 536 and mist separators 537, 538 which are disposed in the pipe 534 that is connected to the pipe 535. The air which circulates from the cleaning and drying area 540 through the scrubber 536 and the mist separators 537, 538 back into the circulation duct 534 over the ceiling 530*a* is free of any chemical mist and gases. The clean air is then forced through the filters 533 by the fans to circulate back into the processing area 530.

Part of the air is discharged from the processing area 530 through the duct 53 connected to a floor 530*b* of the processing area 530. Air containing a chemical mist and gases is also discharged from the processing area 530, through the duct 553. An amount of fresh air which is commensurate with the amount of air discharged through the duct 553 is supplied from the duct 539 into the plating chamber 530 under the negative pressure developed therein with respect to the pressure in the clean room.

Figure 15:
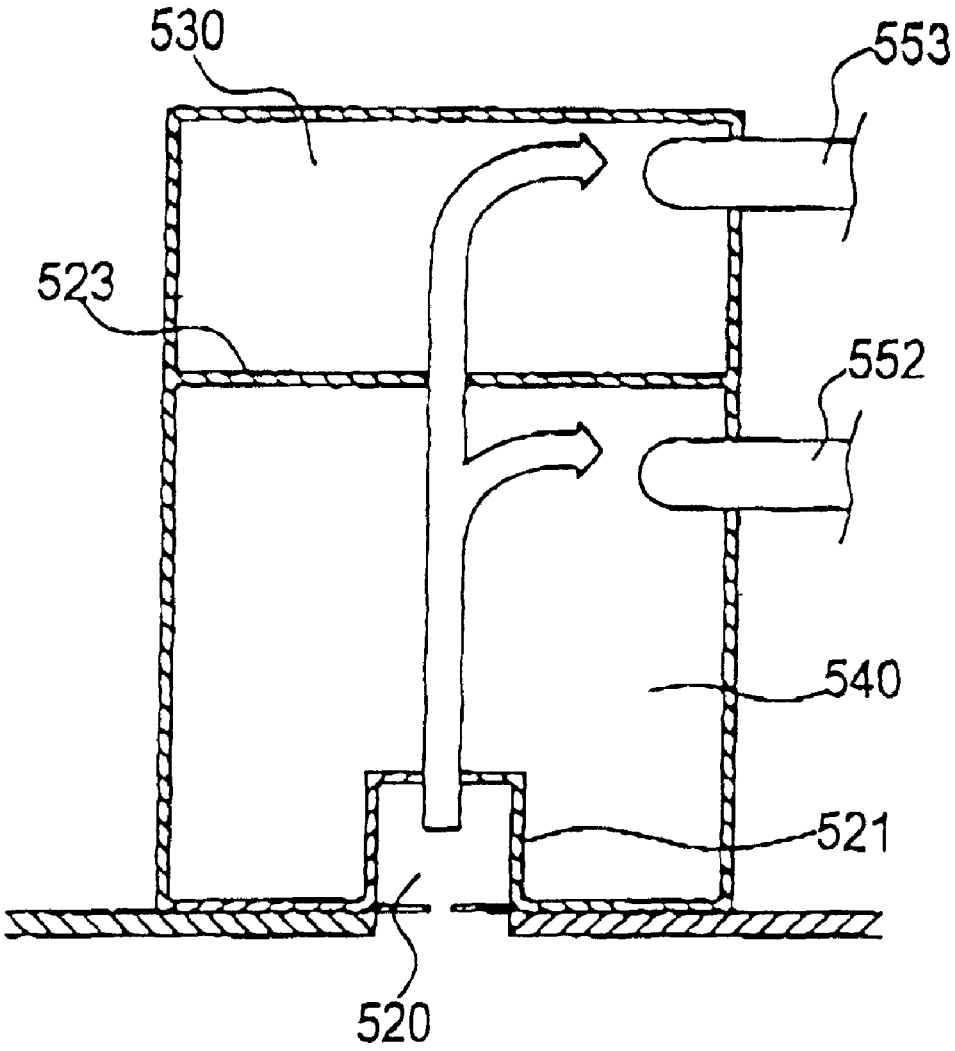
FIG. 15 is a cross-sectional view showing airflows among areas in the substrate plating apparatus shown in FIG. 13.

As described above, the pressure in the loading and unloading area 520 is higher than the pressure in the cleaning and drying area 540 which is higher than the pressure in the processing area 530. When the shutters 522, 524 (see FIG. 13) are opened, therefore, air flows successively through the loading and unloading area 520, the cleaning and drying area 540, and the processing area 530, as shown in FIG. 15. Air discharged from the cleaning and drying area 540 and the processing area 530 flows through the ducts 552, 553 into a common duct 554 (see FIG. 16) which extends out of the clean room.

Figure 16:
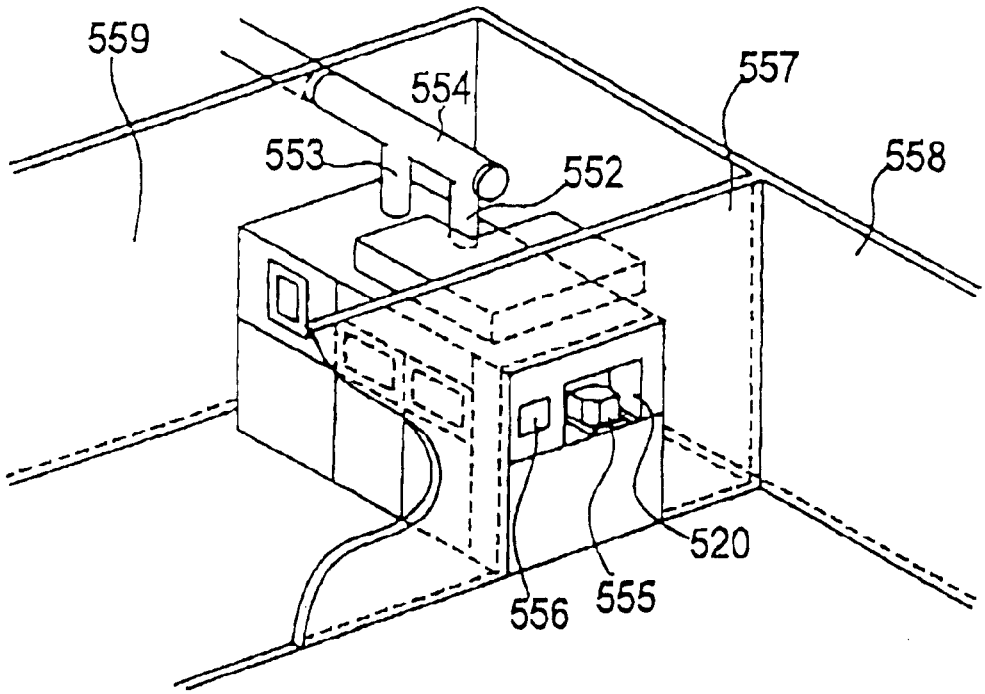
FIG. 16 is a perspective view of the substrate plating apparatus shown in FIG. 13, which is placed in a clean room.

FIG. 16 shows in perspective the substrate plating apparatus shown in FIG. 13, which is placed in the clean room. The loading and unloading area 520 includes a side wall which has a cassette transfer port 555 defined therein and a control panel 556, and which is exposed to a working zone 558 that is compartmented in the clean room by a partition wall 557. The partition wall 557 also compartments a utility zone 559 in the clean room in which the substrate plating apparatus is installed. Other sidewalls of the substrate plating apparatus are exposed to the utility zone 559 whose air cleanness is lower than the air cleanness in the working zone 558.

As described above, the cleaning and drying area 540 is disposed between the loading and unloading area 520, and the processing area 530. The partition 521 is disposed between the loading and unloading area 520, and the cleaning and drying area 540. The partition 523 is disposed between the cleaning and drying area 540, and the processing area 530. A dry semiconductor wafer is loaded from the working zone 558 through the cassette transfer port 555 into the substrate plating apparatus, and then plated in the substrate plating apparatus. The plated semiconductor wafer is cleaned and dried, and then unloaded from the substrate plating apparatus through the cassette transfer port 555 into the working zone 558. Consequently, no particles and mist are applied to the surface of the semiconductor wafer, and the working zone 558 which has higher air cleanness than the utility zone 557 is prevented from being contaminated by particles, chemical mists, and cleaning solution mists.

In the embodiment shown in FIGS. 13 and 14, the substrate plating apparatus has the loading and unloading area 520, the cleaning and drying area 540, and the processing area 530. However, an area accommodating a chemical mechanical polishing unit may be disposed in or adjacent to the processing area 530, and the cleaning and drying area 540 may be disposed in the processing area 530 or between the area accommodating the chemical mechanical polishing unit and the loading and unloading area 520. Any of various other suitable area and unit layouts may be employed insofar as a dry semiconductor wafer can be loaded into the substrate plating apparatus, and a plated semiconductor wafer can be cleaned and dried, and thereafter unloaded from the substrate plating apparatus.

In the embodiment described above, the present invention is applied to the substrate plating apparatus for plating a semiconductor wafer. However, the principles of the present invention are also applicable to a substrate plating apparatus for plating a substrate other than a semiconductor wafer. Furthermore, a region on a substrate plated by the substrate plating apparatus is not limited to an interconnection region on the substrate. The substrate plating apparatus may be used to plate substrates with a metal other than copper.

Figure 17:
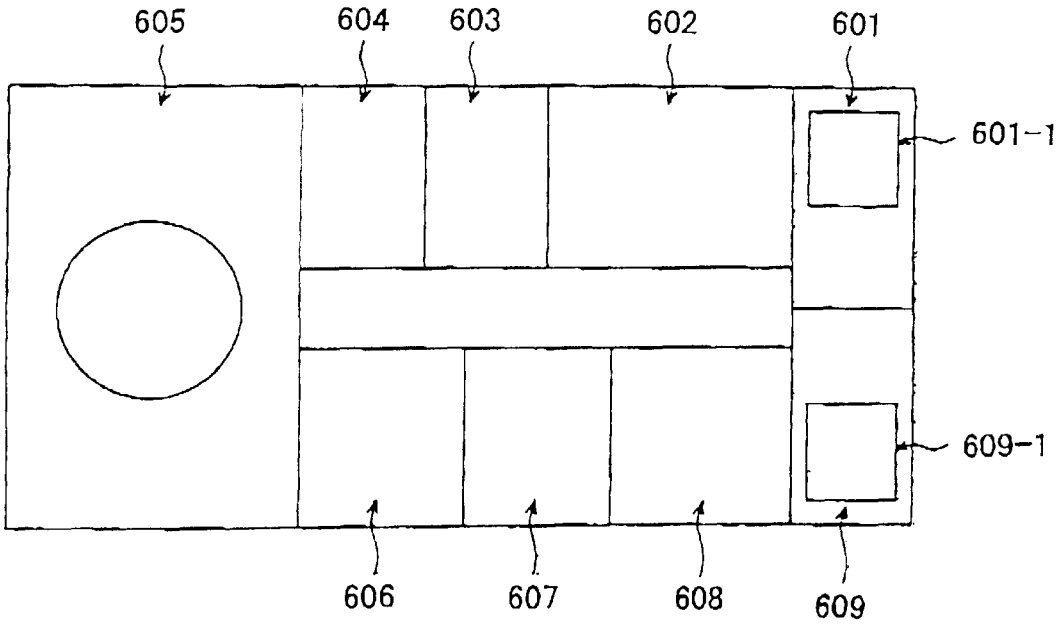
FIG. 17 is a plan view of another example of a substrate plating apparatus.

FIG. 17 is a plan view of another example of a substrate plating apparatus. The substrate plating apparatus shown in FIG. 17 comprises a loading unit 601 for loading a semiconductor wafer, a copper plating chamber 602 for plating a semiconductor wafer with copper, a pair of water cleaning chambers 603, 604 for cleaning a semiconductor wafer with water, a chemical mechanical polishing unit 605 for chemically and mechanically polishing a semiconductor wafer, a pair of water cleaning chambers 606, 607 for cleaning a semiconductor wafer with water, a drying chamber 608 for drying a semiconductor wafer, and an unloading unit 609 for unloading a semiconductor wafer with an interconnection film thereon. The substrate plating apparatus also has a wafer transfer mechanism (not shown) for transferring semiconductor wafers to the chambers 602, 603, 604, the chemical mechanical polishing unit 605, the chambers 606, 607, 608, and the unloading unit 609. The loading unit 601, the chambers 602, 603, 604, the chemical mechanical polishing unit 605, the chambers 606, 607, 608, and the unloading unit 609 are combined into a single unitary arrangement as apparatus.

The substrate plating apparatus operates as follows: The wafer transfer mechanism transfers a semiconductor wafer W on which an interconnection film has not yet been formed from a wafer cassette 601-1 placed in the loading unit 601 to the copper plating chamber 602. In the copper plating chamber 602, a plated copper film is formed on a surface of the semiconductor wafer W having an interconnection region composed of an interconnection trench and an interconnection hole (contact hole).

After the plated copper film is formed on the semiconductor wafer W in the copper plating chamber 602, the semiconductor wafer W is transferred to one of the water cleaning chambers 603, 604 by the wafer transfer mechanism and cleaned by water in one of the water cleaning chambers 603, 604. The cleaned semiconductor wafer W is transferred to the chemical mechanical polishing unit 605 by the wafer transfer mechanism. The chemical mechanical polishing unit 605 removes the unwanted plated copper film from the surface of the semiconductor wafer W, leaving a portion of the plated copper film in the interconnection trench and the interconnection hole. A barrier layer made of TiN or the like is formed on the surface of the semiconductor wafer W, including the inner surfaces of the interconnection trench and the interconnection hole, before the plated copper film is deposited.

Then, the semiconductor wafer W with the remaining plated copper film is transferred to one of the water cleaning chambers 606, 607 by the wafer transfer mechanism and cleaned by water in one of the water cleaning chambers 607, 608. The cleaned semiconductor wafer W is then dried in the drying chamber 608, after which the dried semiconductor wafer W with the remaining plated copper film serving as an interconnection film is placed into a wafer cassette 609-1 in the unloading unit 609.

Figure 18:
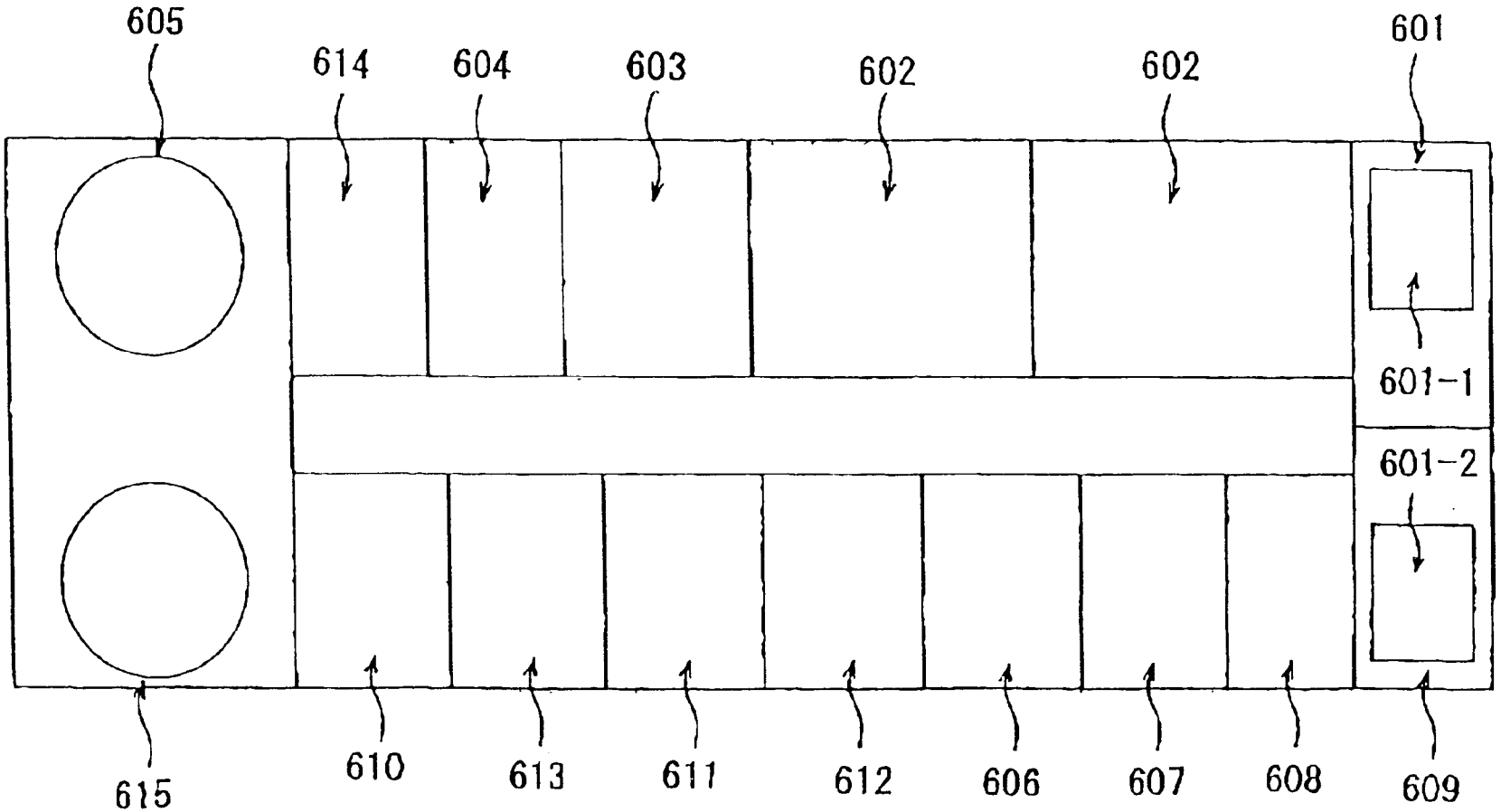
FIG. 18 is a plan view of still another example of a substrate plating apparatus.

FIG. 18 shows a plan view of still another example of a substrate plating apparatus. The substrate plating apparatus shown in FIG. 18 differs from the substrate plating apparatus shown in FIG. 17 in that it additionally includes a copper plating chamber 602, a water cleaning chamber 610, a pretreatment chamber 611, a protective layer plating chamber 612 for forming a protective plated layer on a plated copper film on a semiconductor wafer, water cleaning chamber 613, 614, and a chemical mechanical polishing unit 615. The loading unit 601, the chambers 602, 602, 603, 604, 614, the chemical mechanical polishing unit 605, 615, the chambers 606, 607, 608, 610, 611, 612, 613, and the unloading unit 609 are combined into a single unitary arrangement as an apparatus.

The substrate plating apparatus shown in FIG. 18 operates as follows: A semiconductor wafer W is supplied from the wafer cassette 601-1 placed in the loading unit 601 successively to one of the copper plating chambers 602, 602. In one of the copper plating chamber 602, 602, a plated copper film is formed on a surface of a semiconductor wafer W having an interconnection region composed of an interconnection trench and an interconnection hole (contact hole). The two copper plating chambers 602, 602 are employed to allow the semiconductor wafer W to be plated with a copper film for a long period of time. Specifically, the semiconductor wafer W may be plated with a primary copper film according to electroplating in one of the copper plating chamber 602, and then plated with a secondary copper film according to electroless plating in the other copper plating chamber 602. The substrate plating apparatus may have more than two copper plating chambers.

The semiconductor wafer W with the plated copper film formed thereon is cleaned by water in one of the water cleaning chambers 603, 604. Then, the chemical mechanical polishing unit 605 removes the unwanted portion of the plated copper film from the surface of the semiconductor wafer W, leaving a portion of the plated copper film in the interconnection trench and the interconnection hole.

Thereafter, the semiconductor wafer W with the remaining plated copper film is transferred to the water cleaning chamber 610, in which the semiconductor wafer W is cleaned with water. Then, the semiconductor wafer W is transferred to the pretreatment chamber 611, and pretreated therein for the deposition of a protective plated layer. The pretreated semiconductor wafer W is transferred to the protective layer-plating chamber 612. In the protective layer plating chamber 612, a protective plated layer is formed on the plated copper film in the interconnection region on the semiconductor wafer W. For example, the protective plated layer is formed with an alloy of nickel (Ni) and boron (B) by electroless plating.

After semiconductor wafer is cleaned in one of the water cleaning chamber 613, 614, an upper portion of the protective plated layer deposited on the plated copper film is polished off to planarize the protective plated layer, in the chemical mechanical polishing unit 615, After the protective plated layer is polished, the semiconductor wafer W is cleaned by water in one of the water cleaning chambers 606, 607, dried in the drying chamber 608, and then transferred to the wafer cassette 609-1 in the unloading unit 609.

Figure 19:
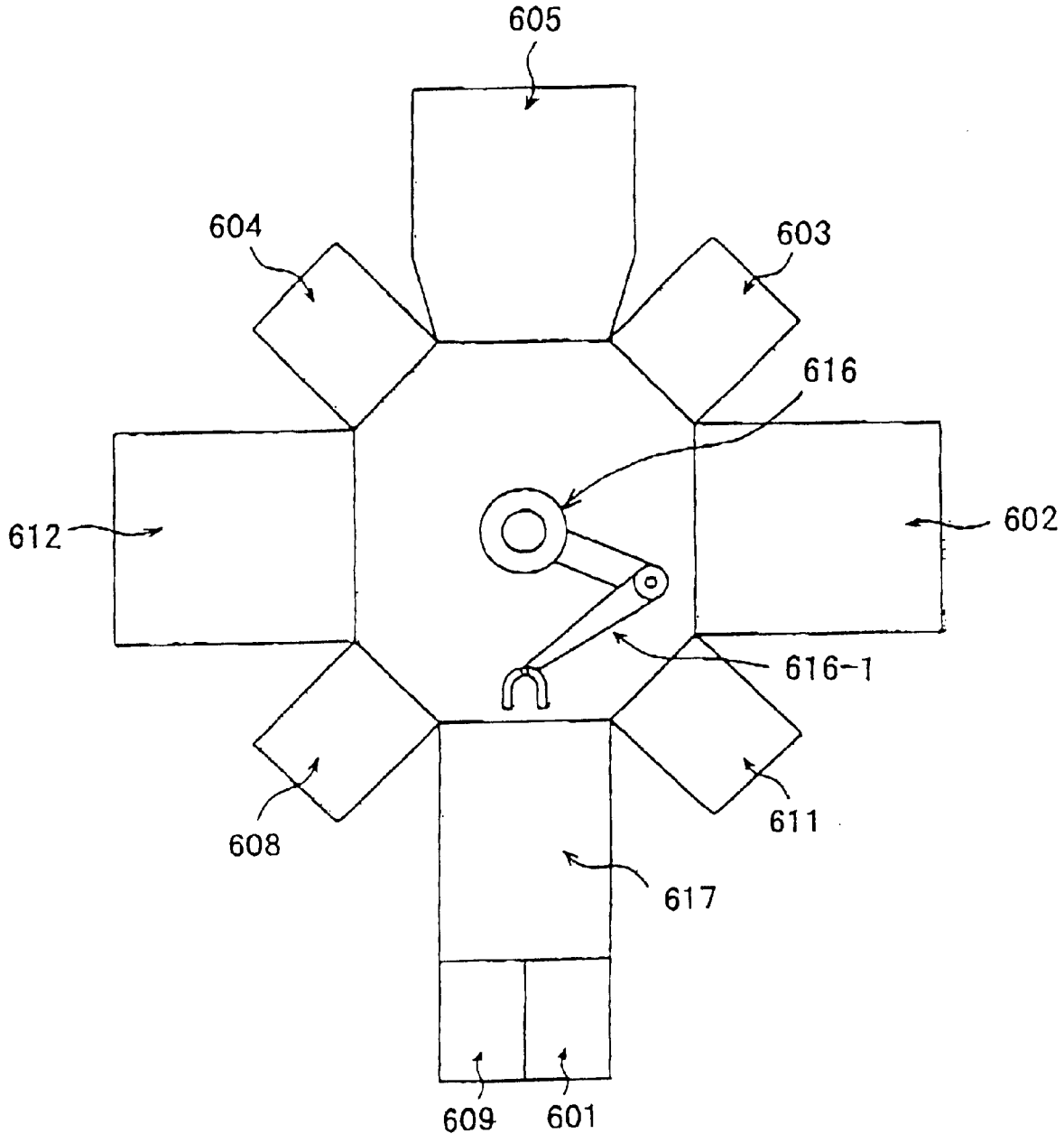
FIG. 19 is a plan view of still another example of a substrate plating apparatus.

FIG. 19 is a plan view of still another example of a substrate plating apparatus. As shown in FIG. 19, the substrate plating apparatus includes a robot 616 at its center which has a robot arm 616-1, and also has a copper plating chamber 602, a pair of water cleaning chambers 603, 604, a chemical mechanical polishing unit 605, a pretreatment chamber 611, a protective layer plating chamber 612, a drying chamber 608, and a loading and unloading station 617 which are disposed around the robot 616 and positioned within the reach of the robot arm 616-1. A loading unit 601 for loading semiconductor wafers and an unloading unit 609 for unloading semiconductor wafers is disposed adjacent to the loading and unloading station 617. The robot 616, the chambers 602, 603, 604, the chemical mechanical polishing unit 605, the chambers 608, 611, 612, the loading and unloading station 617, the loading unit 601, and the unloading unit 609 are combined into a single unitary arrangement as an apparatus.

The substrate plating apparatus shown in FIG. 19 operates as follows:

A semiconductor wafer to be plated is transferred from the loading unit 601 to the loading and unloading station 617, from which the semiconductor wafer is received by the robot arm 616-1 and transferred thereby to the copper plating chamber 602. In the copper plating chamber 602, a plated copper film is formed on a surface of the semiconductor wafer which has an interconnection region composed of an interconnection trench and an interconnection hole. The semiconductor wafer with the plated copper film formed thereon is transferred by the robot arm 616-1 to the chemical mechanical polishing unit 605. In the chemical mechanical polishing unit 605, the plated copper film is removed from the surface of the semiconductor wafer W, leaving a portion of the plated copper film in the interconnection trench and the interconnection hole.

The semiconductor wafer is then transferred by the robot arm 616-1 to the water-cleaning chamber 604, in which the semiconductor wafer is cleaned by water. Thereafter, the semiconductor wafer is transferred by the robot arm 616-1 to the pretreatment chamber 611, in which the semiconductor wafer is pretreated therein for the deposition of a protective plated layer. The pretreated semiconductor wafer is transferred by the robot arm 616-1 to the protective layer plating chamber 612. In the protective layer plating chamber 612, a protective plated layer is formed on the plated copper film in the interconnection region on the semiconductor wafer W. The semiconductor wafer with the protective plated layer formed thereon is transferred by the robot arm 616-1 to the water cleaning chamber 604, in which the semiconductor wafer is cleaned by water. The cleaned semiconductor wafer is transferred by the robot arm 616-1 to the drying chamber 608, in which the semiconductor wafer is dried. The dried semiconductor wafer is transferred by the robot arm 616-1 to the loading and unloading station 617, from which the plated semiconductor wafer is transferred to the unloading unit 609.

Figure 20:
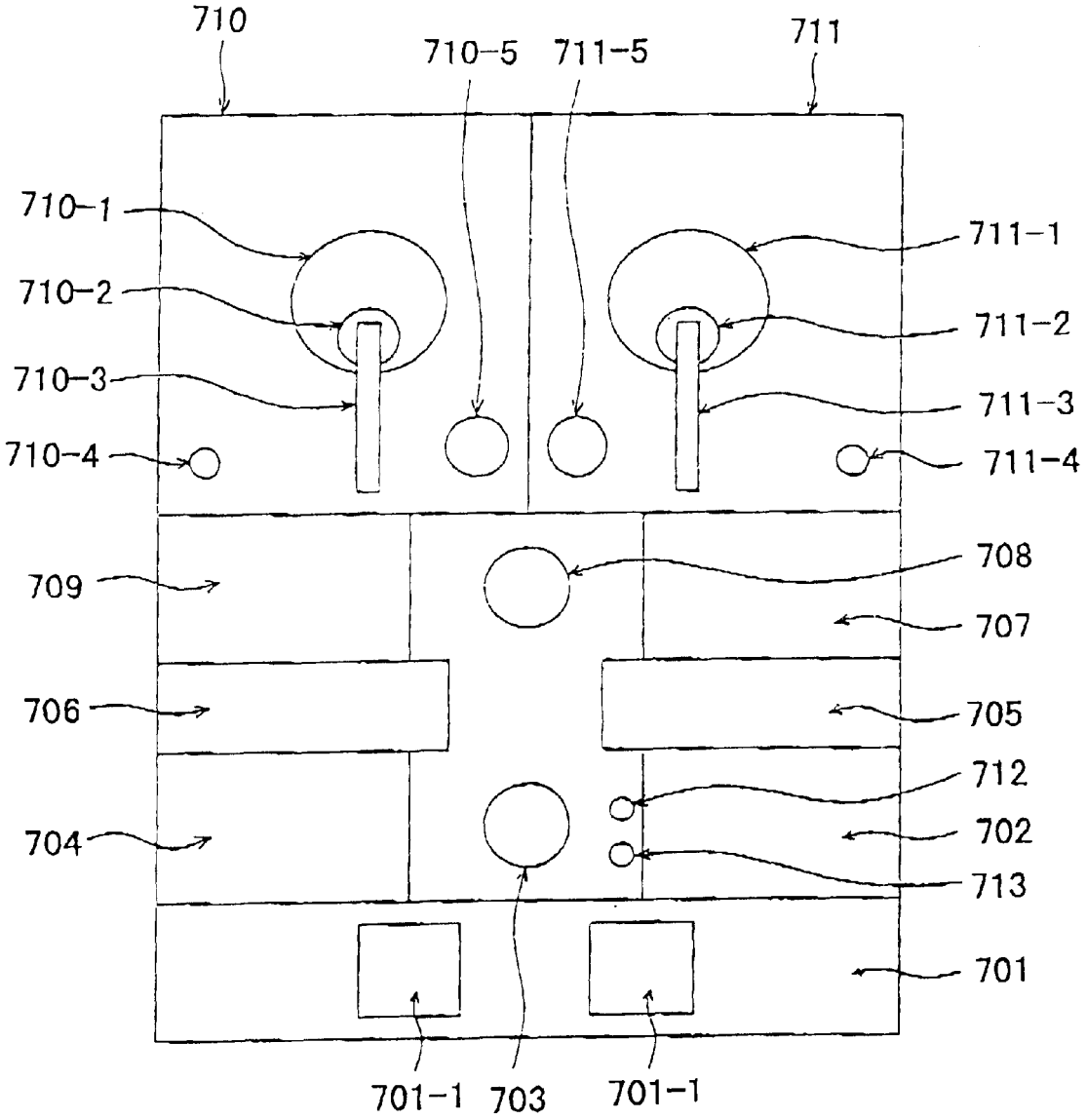
FIG. 20 is a view showing a plan constitution example of the semiconductor substrate processing apparatus.

FIG. 20 is a view showing the plan constitution of another example of a semiconductor substrate processing apparatus. The semiconductor substrate processing apparatus is of a constitution in which there are provided a loading and unloading section 701, a plated Cu film forming unit 702, a first robot 703, a third cleaning machine 704, a reversing machine 705, a reversing machine 706, a second cleaning machine 707, a second robot 708, a first cleaning machine 709, a first polishing apparatus 710, and a second polishing apparatus 711. A before-plating and after-plating film thickness measuring instrument 712 for measuring the film thicknesses before and after plating, and a dry state film thickness measuring instrument 713 for measuring the film thickness of a semiconductor substrate W in a dry state after polishing are placed near the first robot 703.

The first polishing apparatus (polishing unit) 710 has a polishing table 710-1, a top ring 710-2, a top ring head 710-3, a film thickness measuring instrument 710-4, and a pusher 710-5. The second polishing apparatus (polishing unit) 711 has a polishing table 711-1, a top ring 711-2, a top ring head 711-3, a film thickness measuring instrument 711-4, and a pusher 711-5.

A cassette 701-1 accommodating the semiconductor substrates W, in which a via hole and a trench for interconnect are formed, and a seed layer is formed thereon is placed on a loading port of the loading and unloading section 701. The first robot 703 takes out the semiconductor substrate W from the cassette 701-1, and carries the semiconductor substrate W into the plated Cu film forming unit 702 where a plated Cu film 106 is formed. At this time, the film thickness of the seed layer is measured with the before-plating and after-plating film thickness measuring instrument 712. The plated Cu film is formed by carrying out hydrophilic treatment of the face of the semiconductor substrate W, and then Cu plating. After formation of the plated Cu film, rinsing or cleaning of the semiconductor substrate W is carried out in the plated Cu film forming unit 702.

When the semiconductor substrate W is taken out from the plated Cu film forming unit 702 by the first robot 703, the film thickness of the plated Cu film is measured with the before-plating and after-plating film thickness measuring instrument 712. The results of its measurement are recorded into a recording device (not shown) as record data on the semiconductor substrate, and are used for judgment of an abnormality of the plated Cu film forming unit 702. After measurement of the film thickness, the first robot 703 transfers the semiconductor substrate W to the reversing machine 705, and the reversing machine 705 reverses the semiconductor substrate W (the surface on which the plated Cu film has been formed faces downward). The first polishing apparatus 710 and the second polishing apparatus 711 perform polishing in a serial mode and a parallel mode. Next, polishing in the serial mode will be described.

In the serial mode polishing, a primary polishing is performed by the polishing apparatus 710, and a secondary polishing is performed by the polishing apparatus 711. The second robot 708 picks up the semiconductor substrate W on the reversing machine 705, and places the semiconductor substrate W on the pusher 710-5 of the polishing apparatus 710. The top ring 710-2 attracts the semiconductor substrate Won the pusher 710-5 by suction, and brings the surface of the plated Cu film of the semiconductor substrate W into contact with a polishing surface of the polishing table 710-1 under pressure to perform a primary polishing. With the primary polishing, the plated Cu film is basically polished. The polishing surface of the polishing table 710-1 is composed of foamed polyurethane such as IC1000, or a material having abrasive grains fixed thereto or impregnated therein. Upon relative movements of the polishing surface and the semiconductor substrate W, the plated Cu film is polished.

After completion of polishing of the plated Cu film, the semiconductor substrate W is returned onto the pusher 710-5 by the top ring 710-2. The second robot 708 picks up the semiconductor substrate W, and introduces it into the first cleaning machine 709. At this time, a chemical liquid may be ejected toward the face and backside of the semiconductor substrate W on the pusher 710-5 to remove particles therefrom or cause particles to be difficult to adhere thereto.

After completion of cleaning in the first cleaning machine 709, the second robot 708 picks up the semiconductor substrate W, and places the semiconductor substrate W on the pusher 711-5 of the second polishing apparatus 711. The top ring 711-2 attracts the semiconductor substrate W on the pusher 711-5 by suction, and brings the surface of the semiconductor substrate W, which has the barrier layer formed thereon, into contact with a polishing surface of the polishing table 711-1 under pressure to perform the secondary polishing. The constitution of the polishing table is the same as the top ring 711-2. With this secondary polishing, the barrier layer is polished. However, there may be a case in which a Cu film and an oxide film left after the primary polishing are also polished.

A polishing surface of the polishing table 711-1 is composed of foamed polyurethane such as IC1000, or a material having abrasive grains fixed thereto or impregnated therein. Upon relative movements of the polishing surface and the semiconductor substrate W, polishing is carried out. At this time, silica, alumina, ceria, on the like is used as abrasive grains or a slurry. A chemical liquid is adjusted depending on the type of the film to be polished.

Detection of an end point of the secondary polishing is performed by measuring the film thickness of the barrier layer mainly with the use of the optical film thickness measuring instrument, and detecting the film thickness which has become zero, or the surface of an insulating film comprising $SiO_2$ shows up. Furthermore, a film thickness measuring instrument with an image processing function is used as the film thickness measuring instrument 711-4 provided near the polishing table 711-1. By use of this measuring instrument, measurement of the oxide film is made, the results are stored as processing records of the semiconductor substrate W, and used for judging whether the semiconductor substrate W in which secondary polishing has been finished can be transferred to a subsequent step or not. If the end point of the secondary polishing is not reached, repolishing is performed. If over-polishing has been performed beyond a prescribed value due to any abnormality, then the semiconductor substrate processing apparatus is stopped to avoid next polishing so that defective products will not increase.

After completion of the secondary polishing, the semiconductor substrate W is moved to the pusher 711-5 by the top ring 711-2. The second robot 708 picks up the semiconductor substrate W on the pusher 711-5. At this time, a chemical liquid may be ejected toward the face and backside of the semiconductor substrate W on the pusher 711-5 to remove particles therefrom or cause particles to be difficult to adhere thereto.

The second robot 708 carries the semiconductor substrate W into the second cleaning machine 707 where cleaning of the semiconductor substrate W is performed. The constitution of the second cleaning machine 707 is also the same as the constitution of the first cleaning machine 709. The face of the semiconductor substrate W is scrubbed with the PVA sponge rolls using a cleaning liquid comprising pure water to which a surface active agent, a chelating agent, or a pH regulating agent is added. A strong chemical liquid such as DHF is ejected from a nozzle toward the backside of the semiconductor substrate W to perform etching of the diffused Cu thereon. If there is no problem of diffusion, scrubbing cleaning is performed with the PVA sponge rolls using the same chemical liquid as that used for the face.

After completion of the above cleaning, the second robot 708 picks up the semiconductor substrate W and transfers it to the reversing machine 706, and the reversing machine 706 reverses the semiconductor substrate W. The semiconductor substrate W which has been reversed is picked up by the first robot 703, and transferred to the third cleaning machine 704. In the third cleaning machine 704, megasonic water excited by ultrasonic vibrations is ejected toward the face of the semiconductor substrate W to clean the semiconductor substrate W. At this time, the face of the semiconductor substrate W may be cleaned with a known pencil type sponge using a cleaning liquid comprising pure water to which a surface active agent, a chelating agent, or a pH regulating agent is added. Thereafter, the semiconductor substrate W is dried by spin-drying.

As described above, if the film thickness has been measured with the film thickness measuring instrument 711-4 provided near the polishing table 711-1, then the semiconductor substrate W is not subjected to further process and is accommodated into the cassette placed on the unloading port of the loading and unloading section 771.

Figure 21:
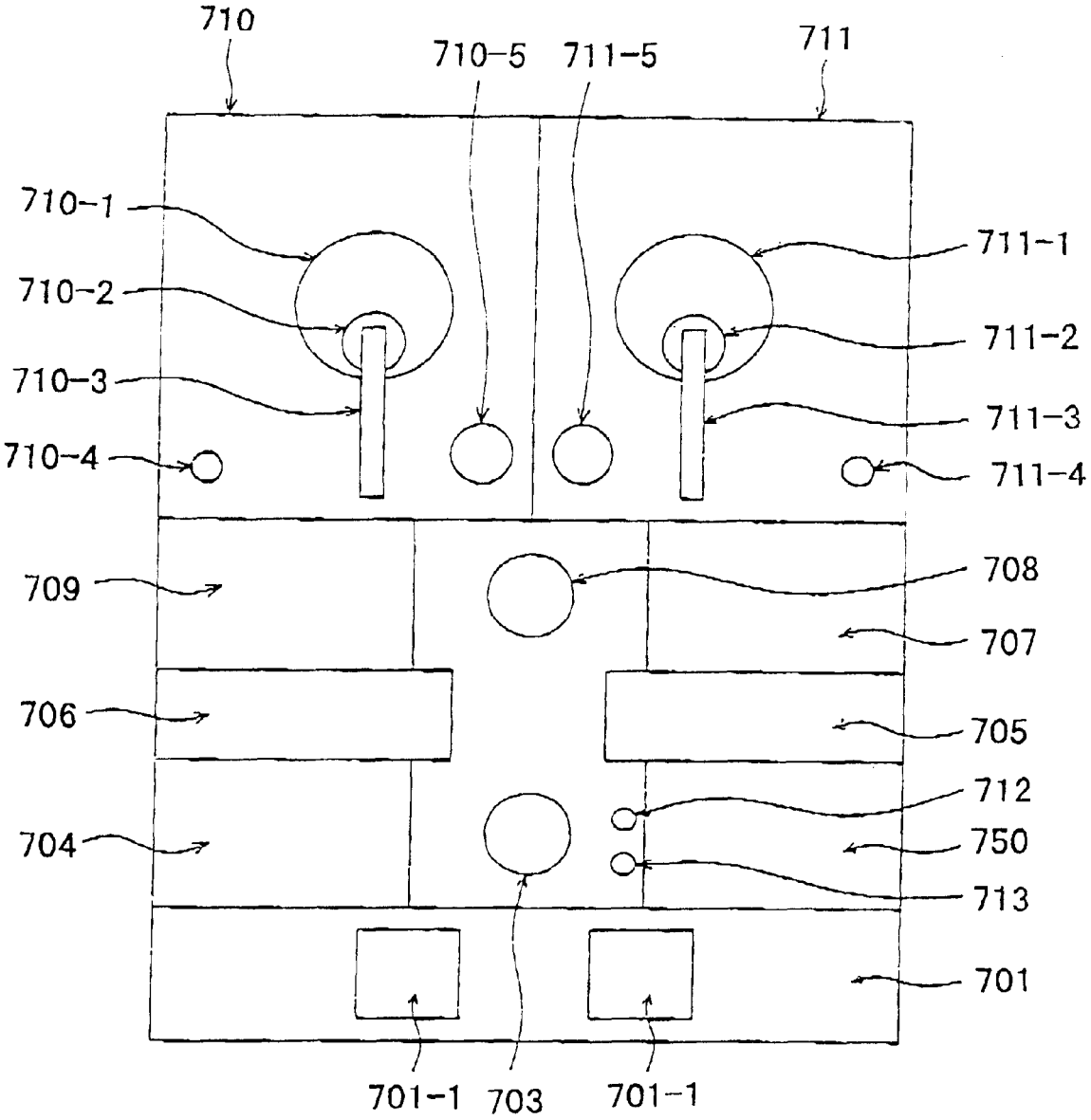
FIG. 21 is a view showing another plan constitution example of the semiconductor substrate processing apparatus.

FIG. 21 is a view showing the plan constitution of another example of a semiconductor substrate processing apparatus. The substrate processing apparatus differs from the substrate processing apparatus shown in FIG. 20 in that a cap plating unit 750 is provided instead of the plated Cu film forming unit 702 in FIG. 20.

A cassette 701-1 accommodating the semiconductor substrates W formed plated Cu film is placed on a load port of a loading and unloading section 701. The semiconductor substrate W taken out from the cassette 701-1 is transferred to the first polishing apparatus 710 or second polishing apparatus 711 in which the surface of the plated Cu film is polished. After completion of polishing of the plated Cu film, the semiconductor substrate W is cleaned in the first cleaning machine 709.

After completion of cleaning in the first cleaning machine 709, the semiconductor substrate W is transferred to the cap plating unit 750 where cap plating is applied onto the surface of the plated Cu film with the aim of preventing oxidation of plated Cu film due to the atmosphere. The semiconductor substrate to which cap plating has been applied is carried by the second robot 708 from the cap plating unit 750 to the second cleaning unit 707 where it is cleaned with pure water or deionized water. The semiconductor substrate after completion of cleaning is returned into the cassette 701-1 placed on the loading and unloading section 701.

Figure 22:
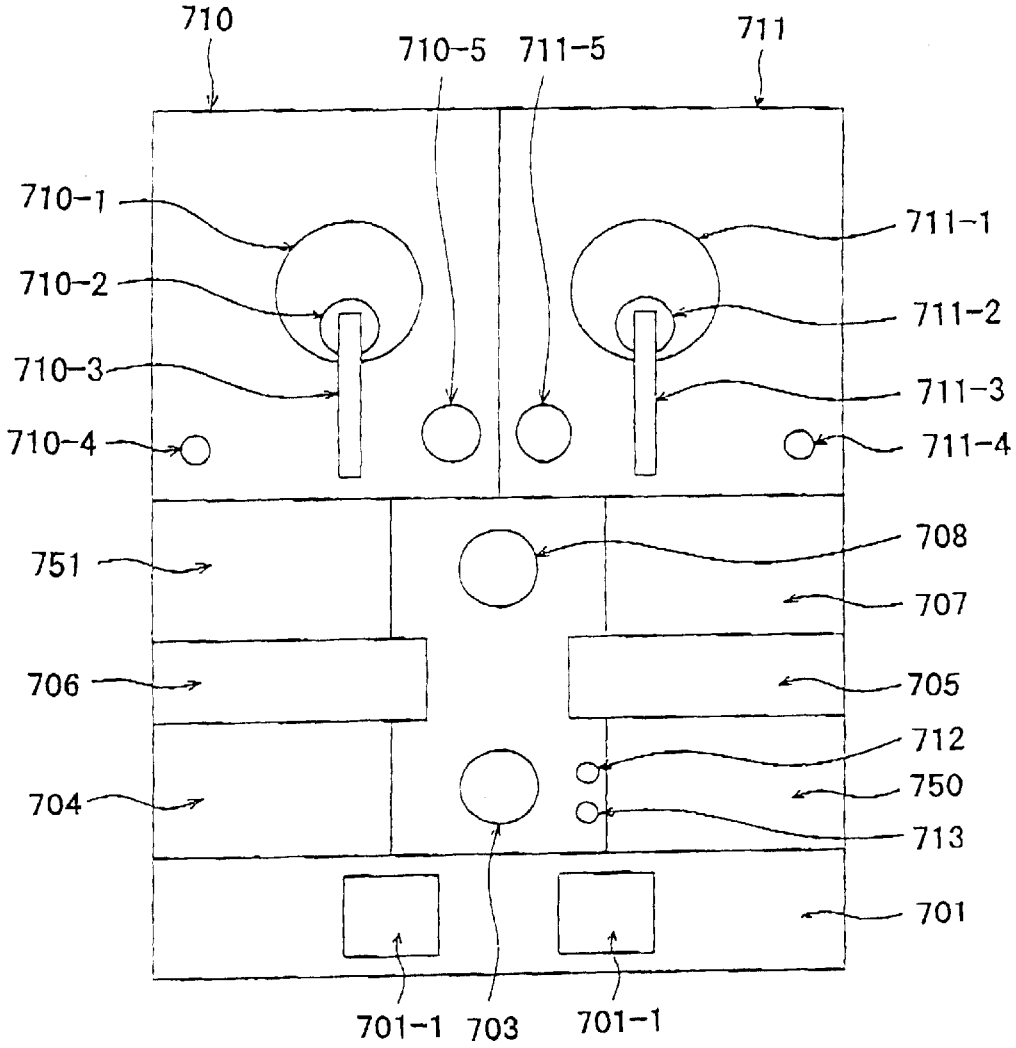
FIG. 22 is a view showing still another plan constitution example of the semiconductor substrate processing apparatus.

FIG. 22 is a view showing the plan constitution of still another example of a semiconductor substrate processing apparatus. The substrate processing apparatus differs from the substrate processing apparatus shown in FIG. 21 in that an annealing unit 751 is provided instead of the third cleaning machine 709 in FIG. 21.

The semiconductor substrate W, which is polished in the polishing unit 710 or 711, and cleaned in the first cleaning machine 709 described above, is transferred to the cap plating unit 750 where cap plating is applied onto the surface of the plated Cu film. The semiconductor substrate to which cap plating has been applied is carried by the second robot 132 from the cap plating unit 750 to the first cleaning unit 707 where it is cleaned.

After completion of cleaning in the first cleaning machine 709, the semiconductor substrate W is transferred to the annealing unit 751 in which the substrate is annealed, whereby the plated Cu film is alloyed so as to increase the electromigration resistance of the plated Cu film. The semiconductor substrate W to which annealing treatment has been applied is carried from the annealing unit 751 to the second cleaning unit 707 where it is cleaned with pure water or deionized water. The semiconductor substrate W after completion of cleaning is returned into the cassette 701-1 placed on the loading and unloading section 701.

Figure 23:
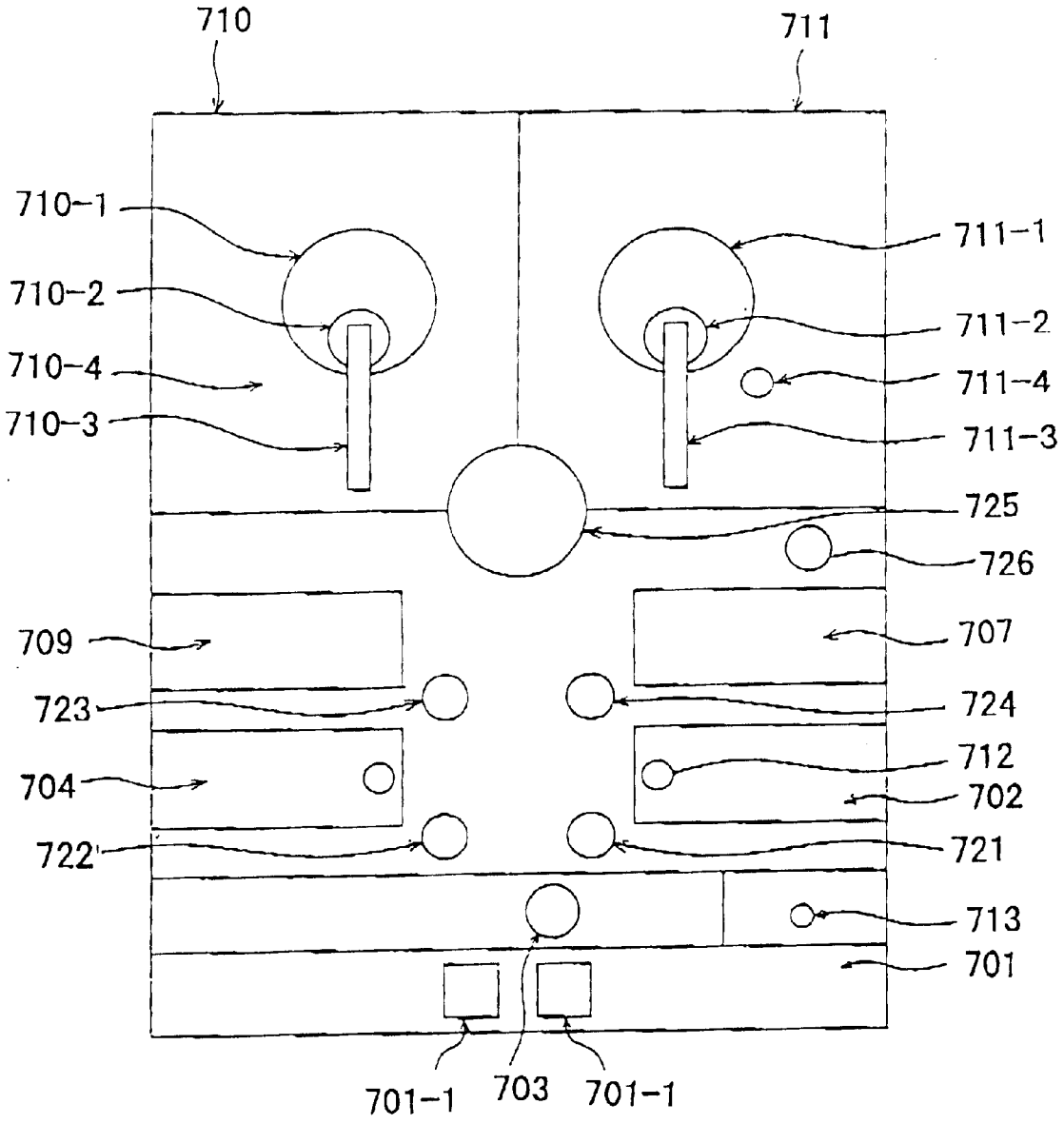
FIG. 23 is a view showing still another plan constitution example of the semiconductor substrate processing apparatus.

FIG. 23 is a view showing a plan layout constitution of another example of the substrate processing apparatus. In FIG. 23, portions denoted by the same reference numerals as those in FIG. 20 show the same or corresponding portions. In the substrate processing apparatus, a pusher indexer 725 is disposed close to a first polishing apparatus 710 and a second polishing apparatus 711. Substrate placing tables 721, 722 are disposed close to a third cleaning machine 704 and a plated Cu film forming unit 702, respectively. A robot 23 is disposed close to a first cleaning machine 709 and the third cleaning machine 704. Further, a robot 724 is disposed close to a second cleaning machine 707 and the plated Cu film forming unit 702, and a dry state film thickness measuring instrument 713 is disposed close to a loading and unloading section 701 and a first robot 703.

In the substrate processing apparatus of the above constitution, the first robot 703 takes out a semiconductor substrate W from a cassette 701-1 placed on the load port of the loading and unloading section 701. After the film thicknesses of a barrier layer and a seed layer are measured with the dry state film thickness measuring instrument 713, the first robot 703 places the semiconductor substrate W on the substrate placing table 721. In the case where the dry state film thickness measuring instrument 713 is provided on the hand of the first robot 703, the film thicknesses are measured thereon, and the substrate is placed on the substrate placing table 721. The second robot 723 transfers the semiconductor substrate W on the substrate placing table 721 to the plated Cu film forming unit 702 in which a plated Cu film is formed. After formation of the plated Cu film, the film thickness of the plated Cu film is measured with a before-plating and after-plating film thickness measuring instrument 712. Then, the second robot 723 transfers the semiconductor substrate W to the pusher indexer 725 and loads it thereon.

Serial Mode

In the serial mode, a top ring head 710-2 holds the semiconductor substrate W on the pusher indexer 725 by suction, transfers it to a polishing table 710-1, and presses the semiconductor substrate W against a polishing surface on the polishing table 710-1 to perform polishing. Detection of the end point of polishing is performed by the same method as described above. The semiconductor substrate W after completion of polishing is transferred to the pusher indexer 725 by the top ring head 710-2, and loaded thereon. The second robot 723 takes out the semiconductor substrate W, and carries it into the first cleaning machine 709 for cleaning. Then, the semiconductor substrate W is transferred to the pusher indexer 725, and loaded thereon.

A top ring head 711-2 holds the semiconductor substrate W on the pusher indexer 725 by suction, transfers it to a polishing table 711-1, and presses the semiconductor substrate W against a polishing surface on the polishing table 711-1 to perform polishing. Detection of the end point of polishing is performed by the same method as described above. The semiconductor substrate W after completion of polishing is transferred to the pusher indexer 725 by the top ring head 711-2, and loaded thereon. The third robot 724 picks up the semiconductor substrate W, and its film thickness is measured with a film thickness measuring instrument 726. Then, the semiconductor substrate W is carried into the second cleaning machine 707 for cleaning. Thereafter, the semiconductor substrate W is carried into the third cleaning machine 704, where it is cleaned and then dried by spin-drying. Then, the semiconductor substrate W is picked up by the third robot 724, and placed on the substrate placing table 722.

Parallel Mode

In the parallel mode, the top ring head 710-2 or 711-2 holds the semiconductor substrate W on the pusher indexer 725 by suction, transfers it to the polishing table 710-1 or 711-1, and presses the semiconductor substrate W against the polishing surface on the polishing table 710-1 or 711-1 to perform polishing. After measurement of the film thickness, the third robot 724 picks up the semiconductor substrate W, and places it on the substrate placing table 722.

The first robot 703 transfers the semiconductor substrate W on the substrate placing table 722 to the dry state film thickness measuring instrument 713. After the film thickness is measured, the semiconductor substrate W is returned to the cassette 701-1 of the loading and unloading section 701.

Figure 24:
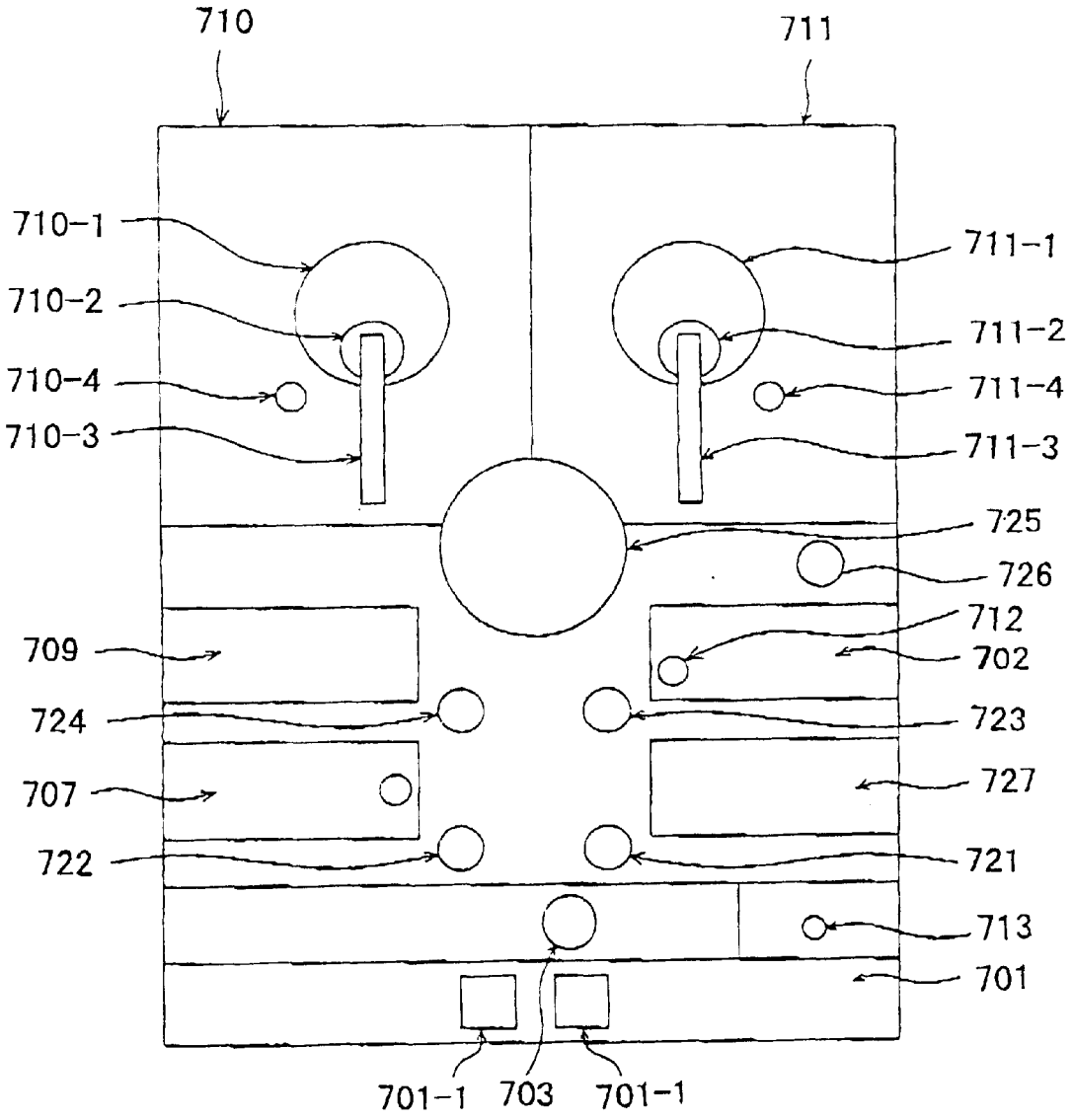
FIG. 24 is a view showing still another plan constitution example of the semiconductor substrate processing apparatus.

FIG. 24 is a view showing another plan layout constitution of the substrate processing apparatus. The substrate processing apparatus is such a substrate processing apparatus which forms a seed layer and a plated Cu film on a semiconductor substrate W having no seed layer formed thereon, and polishes these films to form interconnects.

In the substrate polishing apparatus, a pusher indexer 725 is disposed close to a first polishing apparatus 710 and a second polishing apparatus 711, substrate placing tables 721, 722 are disposed close to a second cleaning machine 707 and a seed layer forming unit 727, respectively, and a robot 723 is disposed close to the seed layer forming unit 727 and a plated Cu film forming unit 702. Further, a robot 724 is disposed close to a first cleaning machine 709 and the second cleaning machine 707, and a dry state film thickness measuring instrument 713 is disposed close to a loading and unloading section 701 and a first robot 702.

The first robot 703 takes out a semiconductor substrate W having a barrier layer thereon from a cassette 701-1 placed on the load port of the loading and unloading section 701, and places it on the substrate placing table 721. Then, the second robot 723 transports the semiconductor substrate W to the seed layer forming unit 727 where a seed layer is formed. The seed layer is formed by electroless plating. The second robot 723 enables the semiconductor substrate having the seed layer formed thereon to be measured in thickness of the seed layer by the before-plating and after-plating film thickness measuring instrument 712. After measurement of the film thickness, the semiconductor substrate is carried into the plated Cu film forming unit 702 where a plated Cu film is formed.

After formation of the plated Cu film, its film thickness is measured, and the semiconductor substrate is transferred to a pusher indexer 725. A top ring 710-2 or 711-2 holds the semiconductor substrate W on the pusher indexer 725 by suction, and transfers it to a polishing table 710-1 or 711-1 to perform polishing. After polishing, the top ring 710-2 or 711-2 transfers the semiconductor substrate W to a film thickness measuring instrument 710-4 or 711-4 to measure the film thickness. Then, the top ring 710-2 or 711-2 transfers the semiconductor substrate W to the pusher indexer 725, and places it thereon.

Then, the third robot 724 picks up the semiconductor substrate W from the pusher indexer 725, and carries it into the first cleaning machine 709. The third robot 724 picks up the cleaned semiconductor substrate W from the first cleaning machine 709, carries it into the second cleaning machine 707, and places the cleaned and dried semiconductor substrate on the substrate placing table 722. Then, the first robot 703 picks up the semiconductor substrate W, and transfers it to the dry state film thickness measuring instrument 713 in which the film thickness is measured, and the first robot 703 carries it into the cassette 701-1 placed on the unload port of the loading and unloading section 701.

In the substrate processing apparatus shown in FIG. 24, interconnects are formed by forming a barrier layer, a seed layer and a plated Cu film on a semiconductor substrate W having a via hole or a trench of a circuit pattern formed therein, and polishing them.

The cassette 701-1 accommodating the semiconductor substrates W before formation of the barrier layer is placed on the load port of the loading and unloading section 701. The first robot 703 takes out the semiconductor substrate W from the cassette 701-1 placed on the load port of the loading and unloading section 701, and places it on the substrate placing table 721. Then, the second robot 723 transports the semiconductor substrate W to the seed layer forming unit 727 where a barrier layer and a seed layer are formed. The barrier layer and the seed layer are formed by electroless plating. The second robot 723 brings the semiconductor substrate W having the barrier layer and the seed layer formed thereon to the before-plating and after-plating film thickness measuring instrument 712 which measures the film thicknesses of the barrier layer and the seed layer. After measurement of the film thicknesses, the semiconductor substrate W is carried into the plated Cu film forming unit 702 where a plated Cu film is formed.

Figure 25:
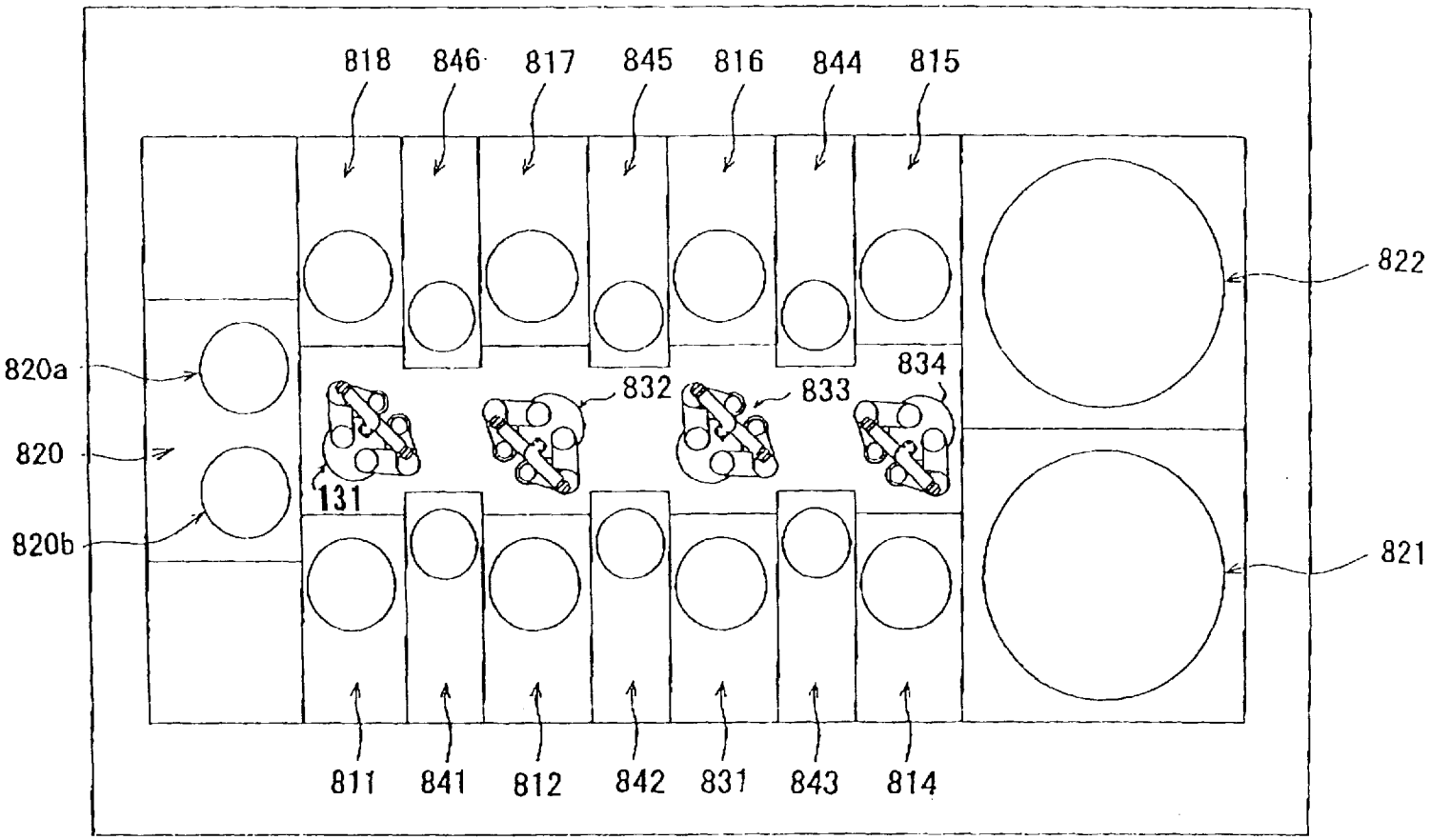
FIG. 25 is a view showing still another plan constitution example of the semiconductor substrate processing apparatus.

FIG. 25 is a view showing plan layout constitution of another example of the substrate processing apparatus. In the substrate processing apparatus, there are provided a barrier layer forming unit 811, a seed layer forming unit 812, a plated film forming unit 813, an annealing unit 814, a first cleaning unit 815, a bevel and backside cleaning unit 816, a cap plating unit 817, a second cleaning unit 818, a first aligner and film thickness measuring instrument 841, a second aligner and film thickness measuring instrument 842, a first substrate reversing machine 843, a second substrate reversing machine 844, a substrate temporary placing table 845, a third film thickness measuring instrument 846, a loading and unloading section 820, a first polishing apparatus 821, a second polishing apparatus 822, a first robot 831, a second robot 832, a third robot 833, and a fourth robot 834. The film thickness measuring instruments 841, 842, and 846 are units, have the same size as the frontage dimension of other units (plating, cleaning, annealing units, and the like), and are thus interchangeable.

In this example, an electroless Ru plating apparatus can be used as the barrier layer forming unit 811, an electroless Cu plating apparatus as the seed layer forming unit 812, and an electroplating apparatus as the plated film forming unit 813.

Figure 26:
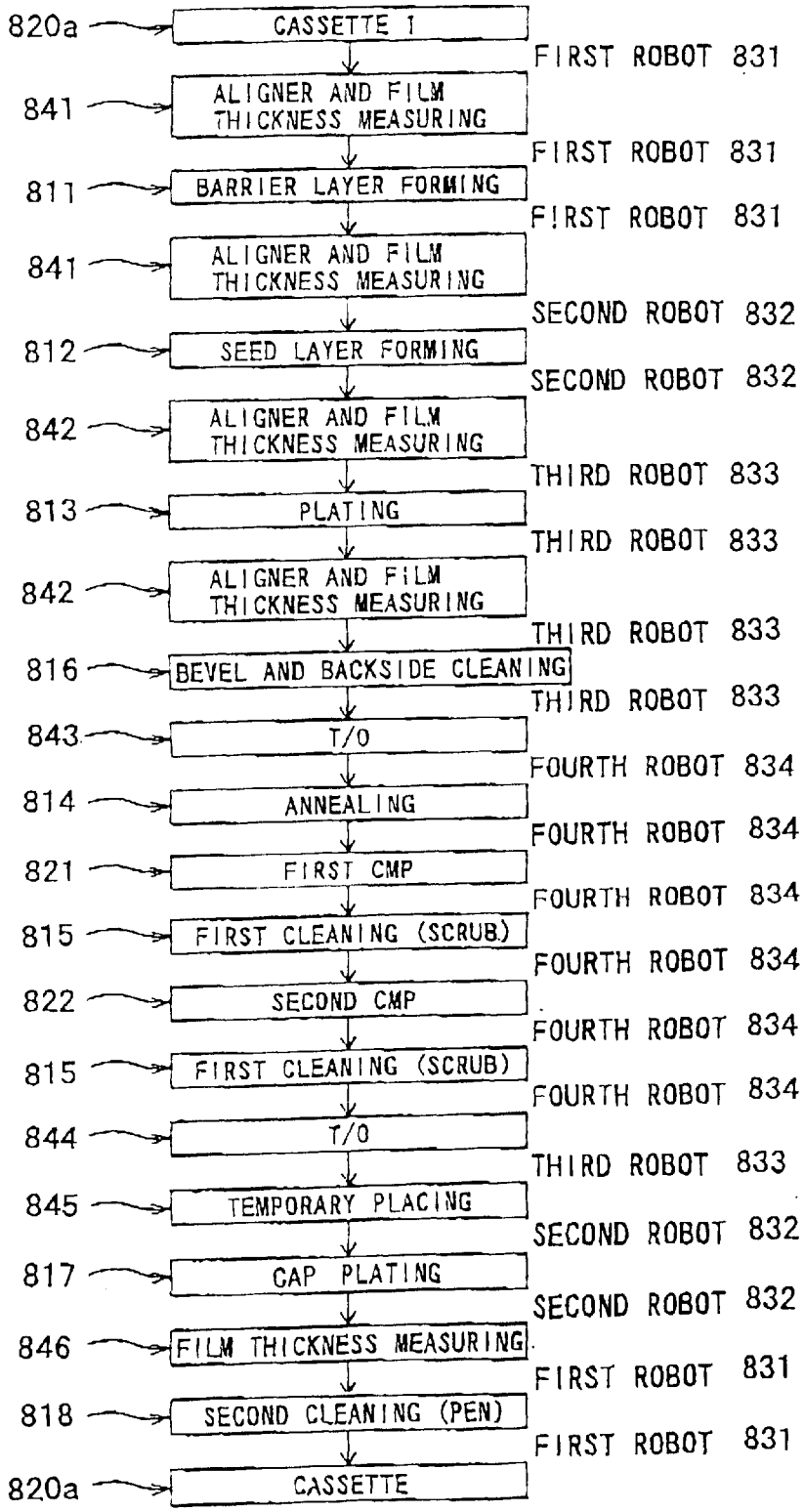
FIG. 26 is a view showing a flow of the respective steps in the semiconductor substrate processing apparatus illustrated in FIG. 25.

FIG. 26 is a flow chart showing the flow of the respective steps in the present substrate processing apparatus. The respective steps in the apparatus will be described according to this flow chart. First, a semiconductor substrate taken out by the first robot 831 from a cassette 820*a* placed on the load and unload unit 820 is placed in the first aligner and film thickness measuring unit 841, in such a state that its surface, to be plated, faces upward. In order to set a reference point for a position at which film thickness measurement is made, notch alignment for film thickness measurement is performed, and then film thickness data on the semiconductor substrate before formation of a Cu film are obtained.

Then, the semiconductor substrate is transported to the barrier layer forming unit 811 by the first robot 831. The barrier layer forming unit 811 is such an apparatus for forming a barrier layer on the semiconductor substrate by electroless Ru plating, and the barrier layer forming unit 811 forms an Ru film as a film for preventing Cu from diffusing into an interlayer insulator film (e.g. $SiO_2$) of a semiconductor device. The semiconductor substrate discharged after cleaning and drying steps is transported by the first robot 831 to the first aligner and film thickness measuring unit 841, where the film thickness of the semiconductor substrate, i.e., the film thickness of the barrier layer is measured.

The semiconductor substrate after film thickness measurement is carried into the seed layer forming unit 812 by the second robot 832, and a seed layer is formed on the barrier layer by electroless Cu plating. The semiconductor substrate discharged after cleaning and drying steps is transported by the second robot 832 to the second aligner and film thickness measuring instrument 842 for determination of a notch position, before the semiconductor substrate is transported to the plated film forming unit 813, which is an impregnation plating unit, and then notch alignment for Cu plating is performed by the film thickness measuring instrument 842. If necessary, the film thickness of the semiconductor substrate before formation of a Cu film may be measured again in the film thickness measuring instrument 842.

The semiconductor substrate which has completed notch alignment is transported by the third robot 833 to the plated film forming unit 813 where Cu plating is applied to the semiconductor substrate. The semiconductor substrate discharged after cleaning and drying steps is transported by the third robot 833 to the bevel and backside cleaning unit 816 where an unnecessary Cu film (seed layer) at a peripheral portion of the semiconductor substrate is removed. In the bevel and backside cleaning unit 816, the bevel is etched in a preset time, and Cu adhering to the backside of the semiconductor substrate is cleaned with a chemical liquid such as hydrofluoric acid. At this time, before transporting the semiconductor substrate to the bevel and backside cleaning unit 816, film thickness measurement of the semiconductor substrate may be made by the second aligner and film thickness measuring instrument 842 to obtain the thickness value of the Cu film formed by plating, and based on the obtained results, the bevel etching time may be changed arbitrarily to carry out etching. The region etched by bevel etching is a region which corresponds to a peripheral edge portion of the substrate and has no circuit formed therein, or a region which is not utilized finally as a chip although a circuit is formed. A bevel portion is included in this region.

The semiconductor substrate discharged after cleaning and drying steps in the bevel and backside cleaning unit 816 is transported by the third robot 833 to the substrate reversing machine 843. After the semiconductor substrate is turned over by the substrate reversing machine 843 to cause the plated surface to be directed downward, the semiconductor substrate is introduced into the annealing unit 814 by the fourth robot 834 for thereby stabilizing a interconnection portion. Before and/or after annealing treatment, the semiconductor substrate is carried into the second aligner and film thickness measuring unit 842 where the film thickness of a copper film formed on the semiconductor substrate is measured. Then, the semiconductor substrate is carried by the fourth robot 834 into the first polishing apparatus 821 in which the Cu film and the seed layer of the semiconductor substrate are polished.

At this time, desired abrasive grains or the like are used, but fixed abrasive may be used in order to prevent dishing and enhance flatness of the face. After completion of primary polishing, the semiconductor substrate is transported by the fourth robot 834 to the first cleaning unit 815 where it is cleaned. This cleaning is scrub-cleaning in which rolls having substantially the same length as the diameter of the semiconductor substrate are placed on the face and the backside of the semiconductor substrate, and the semiconductor substrate and the rolls are rotated, while pure water or deionized water is flowed, thereby performing cleaning of the semiconductor substrate.

After completion of the primary cleaning, the semiconductor substrate is transported by the fourth robot 834 to the second polishing apparatus 822 where the barrier layer on the semiconductor substrate is polished. At this time, desired abrasive grains or the like are used, but fixed abrasive may be used in order to prevent dishing and enhance flatness of the face. After completion of secondary polishing, the semiconductor substrate is transported by the fourth robot 834 again to the first cleaning unit 815 where scrub-cleaning is performed. After completion of cleaning, the semiconductor substrate is transported by the fourth robot 834 to the second substrate reversing machine 844 where the semiconductor substrate is reversed to cause the plated surface to be directed upward, and then the semiconductor substrate is placed on the substrate temporary placing table 845 by the third robot.

The semiconductor substrate is transported by the second robot 832 from the substrate temporary placing table 845 to the cap plating unit 817 where cap plating is applied onto the Cu surface with the aim of preventing oxidation of Cu due to the atmosphere. The semiconductor substrate to which cap plating has been applied is carried by the second robot 832 from the cover plating unit 817 to the third film thickness measuring instrument 146 where the thickness of the copper film is measured. Thereafter, the semiconductor substrate is carried by the first robot 831 into the second cleaning unit 818 where it is cleaned with pure water or deionized water. The semiconductor substrate after completion of cleaning is returned into the cassette 820*a* placed on the loading and unloading section 820.

The aligner and film thickness measuring instrument 841 and the aligner and film thickness measuring instrument 842 perform positioning of the notch portion of the substrate and measurement of the film thickness.

Figure 27:
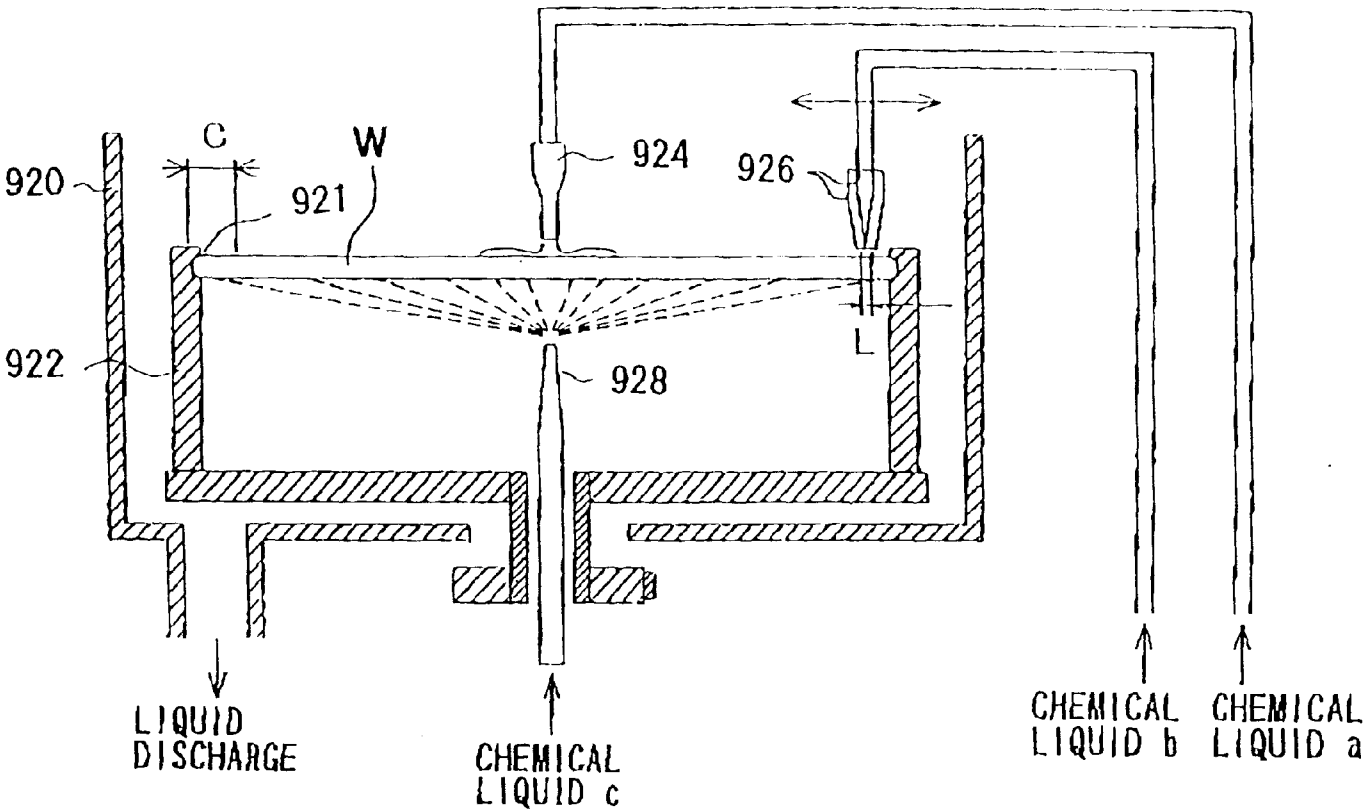
FIG. 27 is a view showing a schematic constitution example of a bevel and backside cleaning unit.

The bevel and backside cleaning unit 816 can perform an edge (bevel) Cu etching and a backside cleaning at the same time, and can suppress growth of a natural oxide film of copper at the circuit formation portion on the surface of the substrate. FIG. 27 shows a schematic view of the bevel and backside cleaning unit 816. As shown in FIG. 27, the bevel and backside cleaning unit 816 has a substrate holding portion 922 positioned inside a bottomed cylindrical waterproof cover 920 and adapted to rotate a substrate W at a high speed, in such a state that the face of the substrate W faces upwardly, while holding the substrate W horizontally by spin chucks 921 at a plurality of locations along a circumferential direction of a peripheral edge portion of the substrate; a center nozzle 924 placed above a nearly central portion of the face of the substrate W held by the substrate holding portion 922; and an edge nozzle 926 placed above the peripheral edge portion of the substrate W. The center nozzle 924 and the edge nozzle 926 are directed downward. A back nozzle 928 is positioned below a nearly central portion of the backside of the substrate W, and directed upward. The edge nozzle 926 is adapted to be movable in a diametrical direction and a height direction of the substrate W.

The width of movement L of the edge nozzle 926 is set such that the edge nozzle 226 can be arbitrarily positioned in a direction toward the center from the outer peripheral end surface of the substrate, and a set value for L is inputted according to the size, usage, or the like of the substrate W. Normally, an edge cut width C is set in the range of 2 mm to 5 mm. In the case where a rotational speed of the substrate is a certain value or higher at which the amount of liquid migration from the backside to the face is not problematic, the copper film within the edge cut width C can be removed.

Next, the method of cleaning with this cleaning apparatus will be described. First, the semiconductor substrate W is horizontally rotated integrally with the substrate holding portion 922, with the substrate being held horizontally by the spin chucks 921 of the substrate holding portion 922. In this state, an acid solution is supplied from the center nozzle 924 to the central portion of the face of the substrate W. The acid solution may be a non-oxidizing acid, and hydrofluoric acid, hydrochloric acid, sulfuric acid, citric acid, oxalic acid, or the like is used. On the other hand, an oxidizing agent solution is supplied continuously or intermittently from the edge nozzle 926 to the peripheral edge portion of the substrate W. As the oxidizing agent solution, one of an aqueous solution of ozone, an aqueous solution of hydrogen peroxide, an aqueous solution of nitric acid, and an aqueous solution of sodium hypochlorite is used, or a combination of these is used.

In this manner, the copper film, or the like formed on the upper surface and end surface in the region of the peripheral edge portion C of the semiconductor substrate W is rapidly oxidized with the oxidizing agent solution, and is simultaneously etched with the acid solution supplied from the center nozzle 924 and spread on the entire face of the substrate, whereby it is dissolved and removed. By mixing the acid solution and the oxidizing agent solution at the peripheral edge portion of the substrate, a steep etching profile can be obtained, in comparison with a mixture of them which is produced in advance being supplied. At this time, the copper etching rate is determined by their concentrations. If a natural oxide film of copper is formed in the circuit-formed portion on the face of the substrate, this natural oxide is immediately removed by the acid solution spreading on the entire face of the substrate according to rotation of the substrate, and does not grow any more. After the supply of the acid solution from the center nozzle 924 is stopped, the supply of the oxidizing agent solution from the edge nozzle 926 is stopped. As a result, silicon exposed on the surface is oxidized, and deposition of copper can be suppressed.

On the other hand, an oxidizing agent solution and a silicon oxide film etching agent are supplied simultaneously or alternately from the back nozzle 928 to the central portion of the backside of the substrate. Therefore, copper or the like adhering in a metal form to the backside of the semiconductor substrate W can be oxidized with the oxidizing agent solution, together with silicon of the substrate, and can be etched and removed with the silicon oxide film etching agent. This oxidizing agent solution is preferably the same as the oxidizing agent solution supplied to the face, because the types of chemicals are decreased in number. Hydrofluoric acid can be used as the silicon oxide film etching agent, and if hydrofluoric acid is used as the acid solution on the face of the substrate, the types of chemicals can be decreased in number. Thus, if the supply of the oxidizing agent is stopped first, a hydrophobic surface is obtained. If the etching agent solution is stopped first, a water-saturated surface (a hydrophilic surface) is obtained, and thus the backside surface can be adjusted to a condition which will satisfy the requirements of a subsequent process.

In this manner, the acid solution, i.e., etching solution is supplied to the substrate to remove metal ions remaining on the surface of the substrate W. Then, pure water is supplied to replace the etching solution with pure water and remove the etching solution, and then the substrate is dried by spin-drying. In this way, removal of the copper film in the edge cut width C at the peripheral edge portion on the face of the semiconductor substrate, and removal of copper contaminants on the backside are performed simultaneously to thus allow this treatment to be completed, for example, within 80 seconds. The etching cut width of the edge can be set arbitrarily (to 2 mm to 5 mm), but the time required for etching does not depend on the cut width.

Annealing treatment performed before the CMP process and after plating has a favorable effect on the subsequent CMP treatment and on the electrical characteristics of interconnection. Observation of the surface of broad interconnection (unit of several micrometers) after the CMP treatment without annealing showed many defects such as microvoids, which resulted in an increase in the electrical resistance of the entire interconnection. Execution of annealing ameliorated the increase in the electrical resistance. In the absence of annealing, thin interconnection showed no voids Thus, the degree of grain growth is presumed to be involved in these phenomena. That is, the following mechanism can be speculated: Grain growth is difficult to occur in thin interconnection. In broad interconnection, on the other hand, grain growth proceeds in accordance with annealing treatment. During the process of grain growth, ultrafine pores in the plated film, which are too small to be seen by the SEM (scanning electron microscope), gather and move upward, thus forming microvoid-like depressions in the upper part of the interconnection. The annealing conditions in the annealing unit 814 are such that hydrogen (2% or less) is added in a gas atmosphere, the temperature is in the range of 300° C. to 400° C., and the time is in the range of 1 to 5 minutes. Under these conditions, the above effects were obtained.

Figure 30:
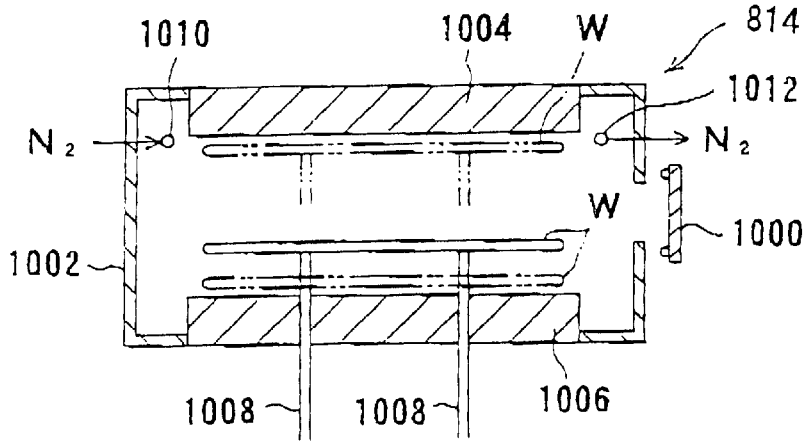
FIG. 30 is a vertical sectional view of an example of an annealing unit.
Figure 31:
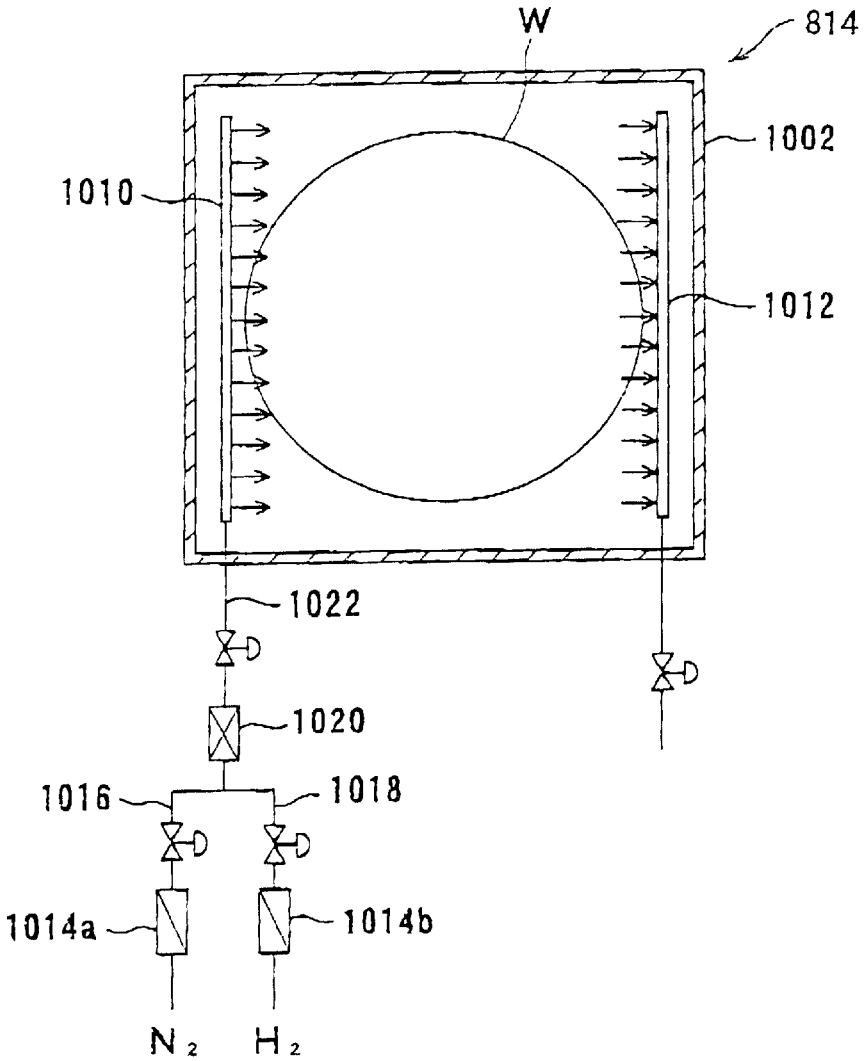
FIG. 31 is a transverse sectional view of the annealing unit.

FIGS. 30 and 31 show the annealing unit 814. The annealing unit 814 comprises a chamber 1002 having a gate 1000 for taking in and taking out the semiconductor substrate W, a hot plate 1004 disposed at an upper position in the chamber 1002 for heating the semiconductor substrate W to e.g. 400° C., and a cool plate 1006 disposed at a lower position in the chamber 1002 for cooling the semiconductor substrate W by, for example, flowing a cooling water inside the plate. The annealing unit 1002 also has a plurality of vertically movable elevating pins 1008 penetrating the cool plate 1006 and extending upward and downward therethrough for placing and holding the semiconductor substrate W on them. The annealing unit further includes a gas introduction pipe 1010 for introducing an antioxidant gas between the semiconductor substrate W and the hot plate 1004 during annealing, and a gas discharge pipe 1012 for discharging the gas which has been introduced from the gas introduction pipe 1010 and flowed between the semiconductor substrate W and the hot plate 1004. The pipes 1010 and 1012 are disposed on the opposite sides of the hot plate 1004.

The gas introduction pipe 1010 is connected to a mixed gas introduction line 1022 which in turn is connected to a mixer 1020 where a $N_2$ gas introduced through a $N_2$ gas introduction line 1016 containing a filter 1014*a*, and a $H_2$ gas introduced through a $H_2$ gas introduction line 1018 containing a filter 1014*b*, are mixed to form a mixed gas which flows through the line 1022 into the gas introduction pipe 1010.

In operation, the semiconductor substrate W. which has been carried in the chamber 1002 through the gate 1000, is held on the elevating pins 1008 and the elevating pins 1008 are raised up to a position at which the distance between the semiconductor substrate W held on the lifting pins 1008 and the hot plate 1004 becomes e.g. 0.1–1.0 mm, In this state, the semiconductor substrate W is then heated to e.g. 400° C. through the hot plate 1004 and, at the same time, the antioxidant gas is introduced from the gas introduction pipe 1010 and the gas is allowed to flow between the semiconductor substrate W and the hot plate 1004 while the gas is discharged from the gas discharge pipe 1012, thereby annealing the semiconductor substrate W while preventing its oxidation. The annealing treatment may be completed in about several tens of seconds to 60 seconds. The heating temperature of the substrate may be selected in the range of 100–600° C.

After the completion of the annealing, the elevating pins 1008 are lowered down to a position at which the distance between the semiconductor substrate W held on the elevating pins 1008 and the cool plate 1006 becomes e.g. 0–0.5 mm. In this state, by introducing a cooling water into the cool plate 1006, the semiconductor substrate W is cooled by the cool plate to a temperature of 100° C. or lower in e.g. 10–60 seconds. The cooled semiconductor substrate is sent to the next step.

A mixed gas of $N_2$ gas with several % of $H_2$ gas is used as the above antioxidant gas. However, $N_2$ gas may be used singly.

Figure 28:
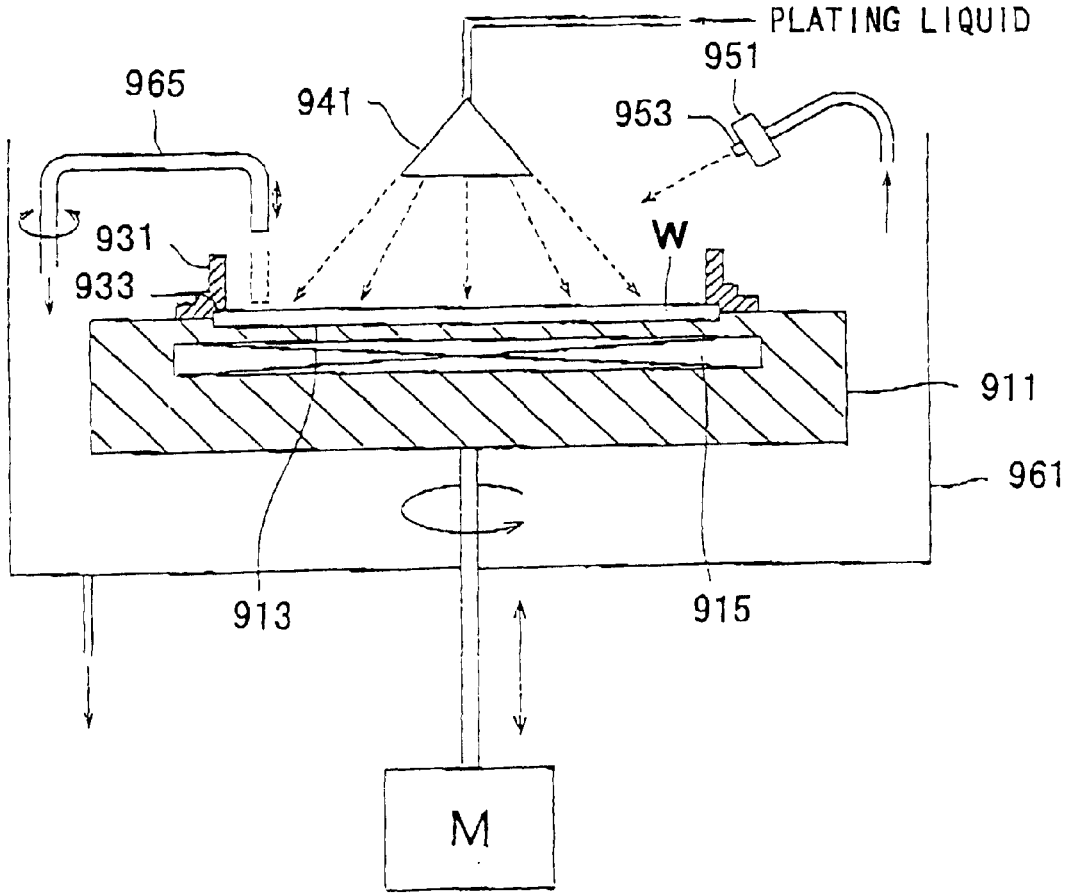
FIG. 28 is a view showing a schematic constitution of an example of an electroless plating apparatus.

FIG. 28 is a schematic constitution drawing of the electroless plating apparatus. As shown in FIG. 28, this electroless plating apparatus comprises holding means 911 for holding a semiconductor substrate W to be plated on its upper surface, a dam member 931 for contacting a peripheral edge portion of a surface to be plated (upper surface) of the semiconductor substrate W held by the holding means 911 to seal the peripheral edge portion, and a shower head 941 for supplying a plating liquid to the surface, to be plated, of the semiconductor substrate W having the peripheral edge portion sealed with the dam member 931. The electroless plating apparatus further comprises cleaning liquid supply means 951 disposed near an upper outer periphery of the holding means 911 for supplying a cleaning liquid to the surface, to be plated, of the semiconductor substrate W, a recovery vessel 961 for recovering a cleaning liquid or the like (plating waste liquid) discharged, a plating liquid recovery nozzle 965 for sucking in and recovering the plating liquid held on the semiconductor substrate W, and a motor M for rotationally driving the holding means 911. The respective members will be described below.

The holding means 911 has a substrate placing portion 913 on its upper surface for placing and holding the semiconductor substrate W. The substrate placing portion 913 is adapted to place and fix the semiconductor substrate W. Specifically, the substrate placing portion 913 has a vacuum attracting mechanism (not shown) for attracting the semiconductor substrate W to a backside thereof by vacuum suction. A backside heater 915, which is planar and heats the surface, to be plated, of the semiconductor substrate W from underside to keep it warm, is installed on the backside of the substrate placing portion 913. The backside heater 915 is composed of, for example, a rubber heater. This holding means 911 is adapted to be rotated by the motor M and is movable vertically by raising and lowering means (not shown).

The dam member 931 is tubular, has a seal portion 933 provided in a lower portion thereof for sealing the outer peripheral edge of the semiconductor substrate w, and is installed so as not to move vertically from the illustrated position.

The shower head 941 is of a structure having many nozzles provided at the front end for scattering the supplied plating liquid in a shower form and supplying it substantially uniformly to the surface, to be plated, of the semiconductor substrate W. The cleaning liquid supply means 951 has a structure for ejecting a cleaning liquid from a nozzle 953.

The plating liquid recovery nozzle 965 is adapted to be movable upward and downward and swingable, and the front end of the plating liquid recovery nozzle 965 is adapted to be lowered inwardly of the dam member 931 located on the upper surface peripheral edge portion of the semiconductor substrate W and to suck in the plating liquid on the semiconductor substrate W.

Next, the operation of the electroless plating apparatus will be described. First, the holding means 911 is lowered from the illustrated state to provide a gap of a predetermined dimension between the holding means 911 and the dam member 931, and the semiconductor substrate W is placed on and fixed to the substrate placing portion 913. An 8 inch wafer, for example, is used as the semiconductor substrate W.

Then, the holding means 911 is raised to bring its upper surface into contact with the lower surface of the dam member 931 as illustrated, and the outer periphery of the semiconductor substrate W is sealed with the seal portion 933 of the dam member 931. At this time, the surface of the semiconductor substrate W is in an open state.

Then, the semiconductor substrate W itself is directly heated by the backside heater 915 to render the temperature of the semiconductor substrate W, for example, 70° C. (maintained until termination of plating). Then, the plating liquid heated, for example, to 50° C. is ejected from the shower head 941 to pour the plating liquid over substantially the entire surface of the semiconductor substrate W. Since the surface of the semiconductor substrate W is surrounded by the dame member 931, the poured plating liquid is all held on the surface of the semiconductor substrate W. The amount of the supplied plating liquid may be a small amount which will become a 1 mm thickness (about 30 ml) on the surface of the semiconductor substrate W. The depth of the plating liquid held on the surface to be plated may be 10 mm or less, and may be even 1 mm as in this embodiment. If a small amount of the supplied plating liquid is sufficient, the heating apparatus for heating the plating liquid may be of a small size. In this example, the temperature of the semiconductor substrate W is raised to 70° C., and the temperature of the plating liquid is raised to 50° C. by heating. Thus, the surface, to be plated, of the semiconductor substrate W becomes, for example, 60° C., and hence a temperature optimal for a plating reaction in this example can be achieved.

The semiconductor substrate W is instantaneously rotated by the motor M to perform uniform liquid wetting of the surface to be plated, and then plating of the surface to be plated is performed in such a state that the semiconductor substrate W is in a stationary state. Specifically, the semiconductor substrate W is rotated at 100 rpm or less for only 1 second to uniformly wet the surface, to be plated, of the semiconductor substrate W with the plating liquid. Then, the semiconductor substrate W is kept stationary, and electroless plating is performed for 1 minute. The instantaneous rotating time is 10 seconds or less at the longest.

After completion of the plating treatment, the front end of the plating liquid recovery nozzle 965 is lowered to an area near the inside of the dam member 931 on the peripheral edge portion of the semiconductor substrate W to suck in the plating liquid. At this time, if the semiconductor substrate W is rotated at a rotational speed of, for example, 100 rpm or less, the plating liquid remaining on the semiconductor substrate W can be gathered in the portion of the dam member 931 on the peripheral edge portion of the semiconductor substrate W under centrifugal force, so that recovery of the plating liquid can be performed with a good efficiency and a high recovery rate. The holding means 911 is lowered to separate the semiconductor substrate W from the dam member 931. The semiconductor substrate W is started to be rotated, and the cleaning liquid (ultrapure water) is jetted at the plated surface of the semiconductor substrate W from the nozzle 953 of the cleaning liquid supply means 951 to cool the plated surface, and simultaneously perform dilution and cleaning, thereby stopping the electroless plating reaction. At this time, the cleaning liquid jetted from the nozzle 953 may be supplied to the dam member 931 to perform cleaning of the dam member 931 at the same time. The plating waste liquid at this time is recovered into the recovery vessel 961 and discarded.

Then, the semiconductor substrate W is rotated at a high speed by the motor M for spin-drying, and then the semiconductor substrate W is removed from the holding means 911.

Figure 29:
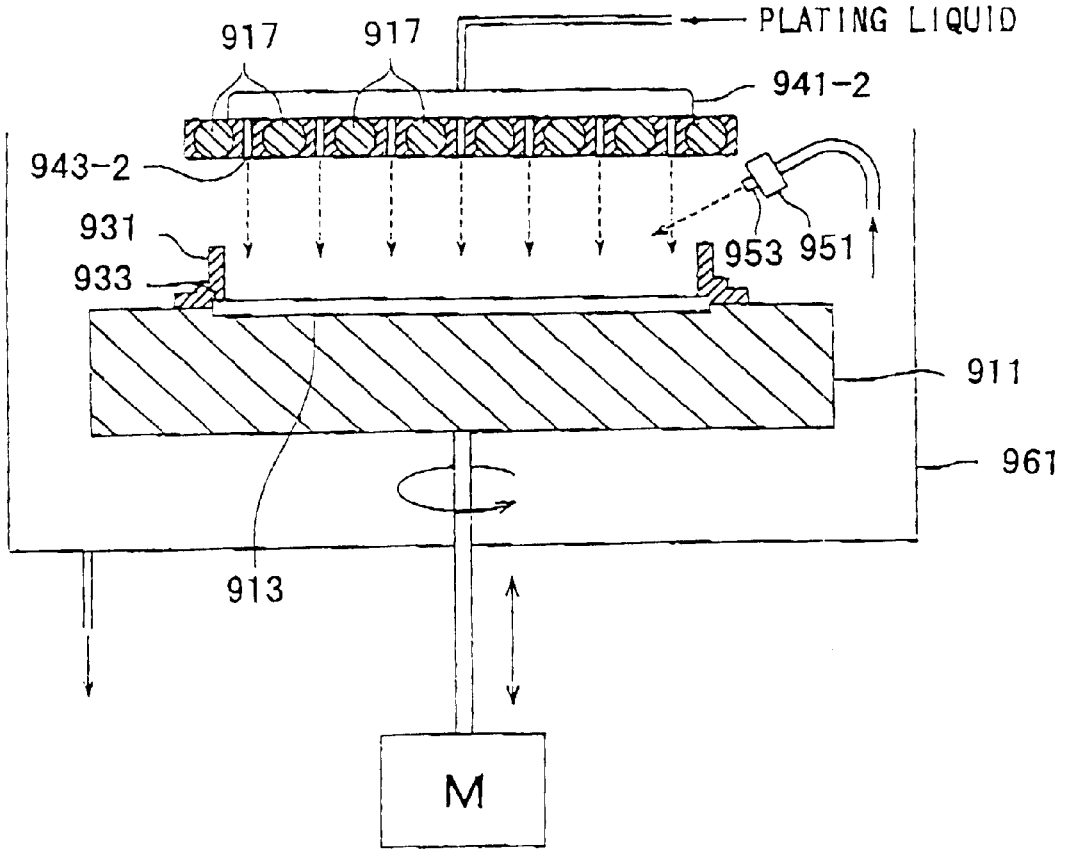
FIG. 29 is a view showing a schematic constitution of another example of an electroless plating apparatus.

FIG. 29 is a schematic constitution drawing of another electroless plating. The electroless plating apparatus of FIG. 29 is different from the electroless plating apparatus of FIG. 28 in that instead of providing the backside heater 915 in the holding means 911, lamp heaters 917 are disposed above the holding means 911, and the lamp heaters 917 and a shower head 941-2 are integrated. For example, a plurality of ring-shaped lamp heaters 917 having different radii are provided concentrically, and many nozzles 943-2 of the shower head 941-2 are open in a ring form from the gaps between the lamp heaters 917. The lamp heaters 917 may be composed of a single spiral lamp heater, or may be composed of other lamp heaters of various structures and arrangements.

Even with this constitution, the plating liquid can be supplied from each nozzle 943-2 to the surface, to be plated, of the semiconductor substrate W substantially uniformly in a shower form. Further, heating and heat retention of the semiconductor substrate W can be performed by the lamp heaters 917 directly uniformly. The lamp heaters 917 heat not only the semiconductor substrate W and the plating liquid, but also ambient air, thus exhibiting a heat retention effect on the semiconductor substrate W.

Direct heating of the semiconductor substrate W by the lamp heaters 917 requires the lamp heaters 917 with a relatively large electric power consumption. In place of such lamp heaters 917, lamp heaters 917 with a relatively small electric power consumption and the backside heater 915 shown in FIG. 27 may be used in combination to heat the semiconductor substrate W mainly with the backside heater 915 and to perform heat retention of the plating liquid and ambient air mainly by the lamp heaters 917. In the same manner as in the aforementioned embodiment, means for directly or indirectly cooling the semiconductor substrate W may be provided to perform temperature control.

The cap plating described above is preferably performed by electroless plating process, but may be performed by electroplating process.

Although certain preferred embodiments of the present invention have been shown and described in detail, it should be understood that various changes and modifications may be made therein without departing from the scope of the appended claims.

What is claimed is:

1. An electronic device having an embedded interconnect of silver, silver alloy, copper or copper alloy, wherein a surface of the interconnect is selectively covered with a protective layer of a Ni—B alloy film having a thickness of 10 to 100 nm, having an FCC crystalline structure, formed by an electroless-plating process with use of an electroless Ni—B plating liquid having a pH within a range from 8 to 12 and a temperature within a range from 50° C. to 90° C.

2. The electronic device according to claim 1, wherein said Ni—B alloy film has a boron content within the range from 0.01 at % to 10 at %.

3. The electronic device according to claim 1, wherein said electroless Ni—B plating liquid comprises nickel ions, a complexing agent for said nickel ions, a reducing agent for said nickel ions, and ammonium ions ($NH_4^+$).

4. The electronic device according to claim 3, wherein said reducing agent comprises an alkylamine borane or a hydrogen boride compound.

5. The electronic device according to claim 3, wherein said ammonium ions are prepared from ammonia water.

6. A method for manufacturing an electronic device according to claim 1, comprising;

electroless plating an electronic device having an embedded interconnect structure with an electroless Ni—B plating liquid to form a protective layer of a Ni—B alloy film having a thickness of 10 to 100 nm selectively on a surface of an interconnect of said electronic device;

wherein said electroless Ni—B plating liquid comprises nickel ions, a complex agent for nickel ions, a reducing agent for nickel ions, and ammonium ions ($NH_4^+$), to obtain the electronic device according to claim 6.

7. The method according to claim 6, wherein said Ni—B alloy film has a boron content within the range from 0.01 at % to 10 at %.

* * * * *